US008238768B2

(12) United States Patent
Koizumi et al.

(10) Patent No.: US 8,238,768 B2
(45) Date of Patent: Aug. 7, 2012

(54) IMAGE FORMING APPARATUS INCLUDING DEVELOPING UNIT AND TONER SUPPLYING UNIT

(75) Inventors: Eichi Koizumi, Kanagawa (JP); Nobutaka Takeuchi, Kanagawa (JP); Akira Yoshida, Kanagawa (JP); Shinji Kato, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 398 days.

(21) Appl. No.: 12/571,970

(22) Filed: Oct. 1, 2009

(65) Prior Publication Data

US 2010/0086320 A1 Apr. 8, 2010

(30) Foreign Application Priority Data

Oct. 8, 2008 (JP) ..... 2008-261561

(51) Int. Cl.
*G03G 15/08* (2006.01)
*G03G 15/09* (2006.01)

(52) U.S. Cl. ..... 399/30; 399/49; 399/58; 399/61; 399/62

(58) Field of Classification Search ..... 399/27, 399/30, 49, 58, 60–62
See application file for complete search history.

(56) References Cited

U.S. PATENT DOCUMENTS 5,327,196 A 7/1994 Kato et al.
5,387,965 A 2/1995 Hasegawa et al.
5,475,476 A 12/1995 Murai et al.
5,682,572 A 10/1997 Murai et al.
5,758,235 A 5/1998 Kosuge et al.
5,765,059 A 6/1998 Kosuge et al.
5,768,664 A 6/1998 Kosuge et al.
5,860,038 A 1/1999 Kato et al.
5,970,276 A 10/1999 Kato
6,055,386 A 4/2000 Kato et al.
6,081,678 A 6/2000 Kato
6,141,520 A 10/2000 Kosuge
6,195,519 B1 2/2001 Isobe et al.
6,366,751 B1 4/2002 Shakuto et al.
6,404,997 B1 * 6/2002 Grace ..... 399/27
6,442,364 B2 8/2002 Kai et al.
6,526,235 B2 2/2003 Kato
6,594,453 B2 7/2003 Kato
6,597,881 B2 7/2003 Hatori et al.
(Continued)

FOREIGN PATENT DOCUMENTS

JP 9-160364 6/1997
(Continued)

OTHER PUBLICATIONS

U.S. Appl. No. 12/571,624, filed Oct. 1, 2009, Koizumi, et al.

*Primary Examiner* — William J Royer
(74) *Attorney, Agent, or Firm* — Oblon, Spivak, McClelland, Maier & Neustadt, L.L.P.

(57) ABSTRACT

A first developer container having a toner supplying opening is provided in a developing unit. A toner concentration sensor is arranged downstream of the toner supplying opening to detect toner concentration in developer. A supply controlling unit is provided to determine an excess or a shortage in the amount of supplied toner based on image information correspondingly to a detection result by the toner concentration sensor, and to correct the driving amount of a toner supplying unit that has been determined based on the image information correspondingly to the recognized excess or shortage in the amount of supplied toner.

16 Claims, 29 Drawing Sheets

U.S. PATENT DOCUMENTS 6,597,885 B2 7/2003 Kai et al.
6,665,511 B2 12/2003 Takeuchi et al.
6,757,509 B2 6/2004 Shoji et al.
6,778,805 B2 8/2004 Kai et al.
6,819,901 B1 11/2004 Yasutomi et al.
6,823,163 B2 11/2004 Sugimoto et al.
6,856,780 B2 2/2005 Kadota et al.
6,978,109 B2 12/2005 Shoji et al.
7,024,141 B2 4/2006 Takeuchi et al.
7,103,305 B2 9/2006 Koike et al.
7,116,932 B2 10/2006 Takeuchi et al.
7,127,198 B2 10/2006 Muramatsu et al.
7,171,145 B2 1/2007 Takeuchi et al.
7,203,433 B2 4/2007 Kato et al.
7,228,081 B2 6/2007 Hasegawa et al.
7,245,853 B2 7/2007 Muramatsu et al.
7,245,861 B2 7/2007 Koike et al.
7,251,420 B2 7/2007 Fujimori et al.
7,260,335 B2 8/2007 Kato et al.
7,346,286 B2 3/2008 Matsumoto et al.
7,356,288 B2 4/2008 Iwata et al.
7,433,613 B2 * 10/2008 Zollner et al. ..... 399/30
7,444,107 B2 10/2008 Takeuchi et al.
7,480,473 B2 1/2009 Matsuura et al.
7,493,058 B2 2/2009 Takeuchi et al.
7,512,364 B2 3/2009 Muramatsu et al.
7,515,844 B2 4/2009 Tanaka et al.
7,536,121 B2 5/2009 Shimizu et al.
7,551,862 B2 6/2009 Tanaka et al.
7,551,864 B2 6/2009 Fujimori et al.
7,551,866 B2 6/2009 Watanabe et al.
7,783,215 B2 * 8/2010 Tanaka ..... 399/62
2006/0274628 A1 12/2006 Tanaka et al.
2007/0025748 A1 2/2007 Ishibashi et al.
2007/0104499 A1 5/2007 Ariizumi et al.
2007/0110457 A1 5/2007 Kato et al.
2007/0116480 A1 5/2007 Takeuchi et al.
2007/0134014 A1 6/2007 Kato et al.
2007/0248368 A1 10/2007 Kato et al.
2007/0269228 A1 11/2007 Takeuchi et al.
2008/0025742 A1 1/2008 Kato et al.
2008/0069580 A1 3/2008 Oshige et al.
2008/0124107 A1 5/2008 Takeuchi et al.
2008/0205923 A1 8/2008 Takeuchi et al.
2008/0253793 A1 10/2008 Ishibashi et al.
2008/0273885 A1 11/2008 Koizumi et al.
2009/0041520 A1 2/2009 Takeuchi et al.
2009/0110413 A1 4/2009 Takeuchi et al.
2009/0116861 A1 5/2009 Oshige et al.

FOREIGN PATENT DOCUMENTS

JP 2001-242694 9/2001
JP 2002-278182 9/2002
JP 2007-133233 5/2007
JP 2008-299315 12/2008

* cited by examiner

IMAGE FORMING APPARATUS INCLUDING DEVELOPING UNIT AND TONER SUPPLYING UNIT

CROSS-REFERENCE TO RELATED APPLICATIONS

The present application claims priority to and incorporates by reference the entire contents of Japanese Patent Application No. 2008-261561 filed in Japan on Oct. 8, 2008.

BACKGROUND OF THE INVENTION

1. Field of the Invention

The present invention relates to an image forming apparatus that uses a developing unit having a structure in which developer, conveyed along a certain circulation channel, is held on a moving surface of a developer holding body to contribute to a development process, and then returned from the surface of the developer holding body to the circulation channel.

2. Description of the Related Art

Japanese Patent Application Laid-open No. H9-160364 discloses a developing apparatus that is a known example of this kind of developing unit. This developing apparatus is shown in FIG. 1. In FIG. 1, a developing apparatus 900 includes a circulation channel for conveying developer, not shown, including toner and magnetic carrier in a circulating manner in a casing, and a developing roller 910. The circulation channel further includes a first developer container 901 and a second developer container 903 that are arranged in the short-length direction with respect to each other. The developer contained in the first developer container 901 that is a part of the circulation channel is conveyed along the longitudinal direction of the space in the first developer container 901, that is, in the direction shown by an arrow A in FIG. 1, by way of driving rotation of a first conveyor screw 902. The first developer container 901 and the second developer container 903 positioned adjacent thereto are communicatively connected at each longitudinal end thereof. The developer that is conveyed toward the end of the arrow A in FIG. 1 in the first developer container 901 by way of driving rotation of the first conveyor screw 902 goes through the connected portion, and enters the second developer container 903. The developer is then conveyed to the direction shown by an arrow B in FIG. 1 that is the direction opposite to that shown by the arrow A by way of driving rotation of a second conveyor screw 904 in the second developer container 903. When the developer is conveyed to the end of the arrow B in the second developer container 903, the developer goes through the connected portion, and enters the most upstream area of the first developer container 901 along the direction shown by the arrow A. In this manner, the developer is conveyed in a circulating manner in the first developer container 901 and the second developer container 903.

The developing roller 910 is arranged at the short-length lateral side of the second developer container 903. The developing roller 910 includes a developing sleeve having a non-magnetic pipe that is driven to rotate, and a magnet roller, not shown, that is held inside the developing sleeve in an unrotatable manner. The developer in the second developer container 903 is carried on the surface of the rotating developing sleeve by way of the magnetic force from the magnet roller, and conveyed to a developing area where the developing sleeve faces a photoconductor not shown. After the surface of the sleeve is developed with the developer, the developer on the surface of the sleeve is collected to the second developer container 903. The concentration of the toner in the developer becomes reduced after the toner contributed to the development process. A controlling unit not shown calculates the number of pixels in an image based on image information thereof, predicts how much toner is consumed for developing the image based on the calculation result, and drives a toner supplying unit, not shown, for a length of time corresponding thereto. Toner is then added to the developer in the first developer container 901 through a toner supplying opening 915 provided near the end of the first developer container 901 at the upstream of the conveyed developer. In this manner, the toner concentration of the developer is recovered. According to such a toner supplying structure, the toner concentration can be recovered more quickly in comparison to a structure where the toner is added after a toner concentration sensor detects a decrease in toner concentration.

However, in the development process, the toner is not necessarily consumed in the amount that is predicted based on the number of pixels in the image. It is possible for the amount of toner consumption to fall below or exceed the prediction, depending on factors such as environmental variation. If the toner is kept being added based on the prediction having such an error with respect to the actual toner consumption, the toner concentration in the developer cannot be maintained appropriately.

SUMMARY OF THE INVENTION

It is an object of the present invention to at least partially solve the problems in the conventional technology.

According to one aspect of the present invention, there is provided an image forming apparatus including: a latent image carrier that holds a latent image; an image information obtaining unit that obtains image information; a latent image forming unit that forms a latent image on the latent image carrier based on the image information; a developing unit that conveys developer-containing toner and carrier along a predetermined circulation channel to a developing area that is an area where a developer holding body faces the latent image carrier by holding the developer on a moving surface of the developer holding body in a supply area that is an area of the circulation channel facing the developer holding body, that develops a latent image on the latent image carrier by attaching the toner in the developer thereto in the developing area, and returns the developer contributed to the development in the developing area to the supply area of the circulation channel along with the movement of the surface of the developer holding body; a toner supplying unit that supplies toner to a non-supply area that is not the supply area in the circulation channel through a toner supplying opening arranged at a predetermined position in the non-supply area; and a controlling unit that determines a driving amount of the toner supplying unit based on the image information. A toner concentration detecting unit is provided at a position downstream of the toner supplying opening in the non-supply area and upstream of the supply area to detect toner concentration in the developer. The controlling unit is structured to recognize an excess or a shortage in an amount of supplied toner correspondingly to a detection result of the toner concentration detecting unit, and to correct a determined value of the driving amount determined based on the image information correspondingly to the excess or the shortage that has been recognized.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An Embodiment of the present invention applied to an electrophotographic printer (hereinafter, simply referred to as "printer") that is an image forming apparatus will now be explained.

To begin with, a basic structure of a printer according to the embodiment will be explained.

Figure 2:
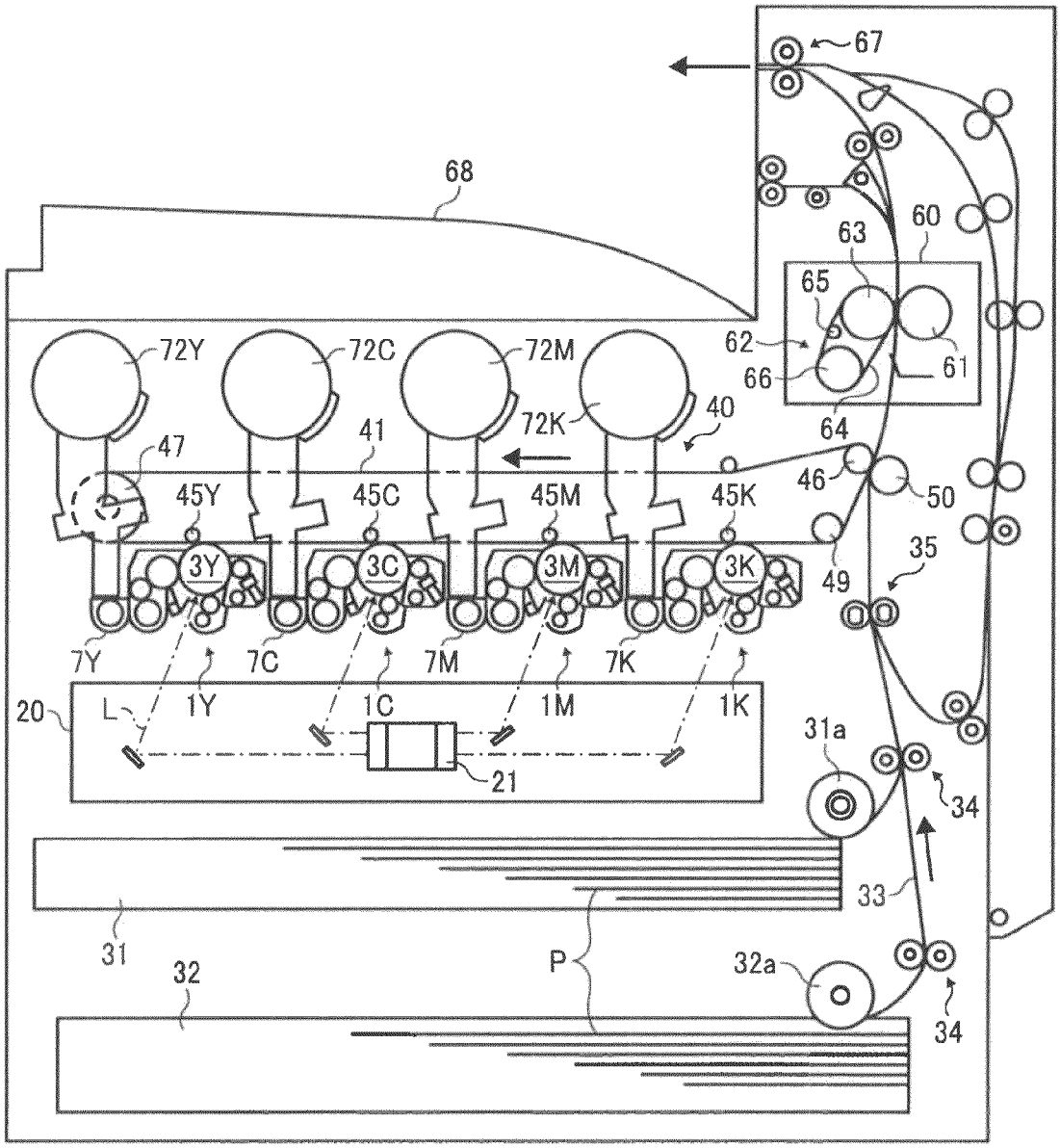
FIG. 2 is a schematic diagram of a printer according to an embodiment of the present invention.

FIG. 2 is a schematic diagram of the printer according to the embodiment. This printer includes four processing units 1Y, 1C, 1M, and 1K each corresponding to each colors of yellow, cyan, magenta, and black (hereinafter, abbreviated as Y, C, M, and K, respectively). Each of these processing units 1Y, 1C, 1M, 1K has the same structure, except that each of these processing units 1Y, 1C, 1M, 1K uses toner of a different color Y, C, M, or K, as an image forming material used in image formation.

Figure 3:
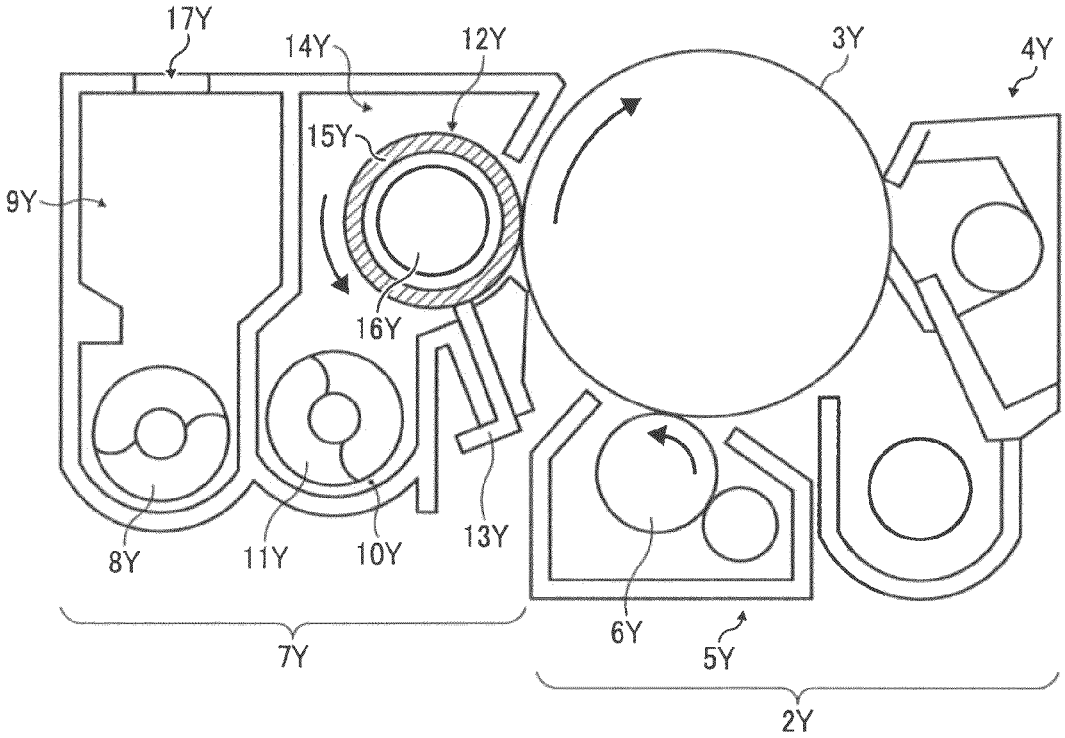
FIG. 3 is an enlarged schematic diagram of a structure of a processing unit that generates a Y toner image in the printer according to the embodiment.
Figure 4:
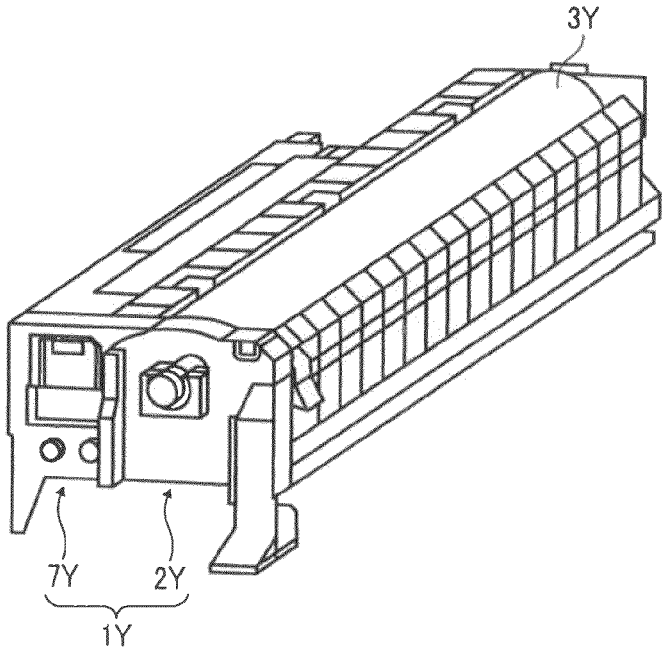
FIG. 4 is an external perspective view of the processing unit shown in FIG. 3.

FIG. 3 is a schematic diagram of a structure of the processing unit 1Y for creating a Y toner image. FIG. 4 is an external perspective view of the processing unit 1Y. As shown FIGS. 3 and 4, the processing unit 1Y includes a photoconductor unit 2Y and a developing unit 7Y. As shown in FIG. 4, the photoconductor unit 2Y and the developing unit 7Y are structured to be integrally attached to or removed from the printer as the processing unit 1Y. When the processing unit 1Y is removed from the printer, the developing unit 7Y can be attached to or removed from the photoconductor unit 2Y that is not shown.

The photoconductor unit 2Y includes a drum-shaped photoconductor 3Y that is a latent image carrier, a drum cleaning unit 4Y, a neutralizing unit not shown, and a charging unit 5Y. The charging unit 5Y as a charging means uniformly charges the surface of the photoconductor 3Y that is driven to rotate by a driving unit, not shown, in the clockwise direction in FIG. 2, using a charging roller 6Y. More specifically, a charging bias, supplied from a power source not shown, is applied to the charging roller 6Y that is driven to rotate in the counter-clockwise direction in FIG. 3, and the charging roller 6Y is brought near to or in contact with the photoconductor 3Y to charge the photoconductor 3Y uniformly. Alternatively, instead of the charging roller 6Y, another charging member, such as a charging brush, may be brought near to or in contact with the photoconductor 3Y. Furthermore, the photoconductor 3Y may also be charged uniformly using a charger such as a scorotoron charger. The surface of the photoconductor 3Y, charged uniformly by the charging unit 5Y, is exposed and scanned by a laser beam emitted from an optical writing unit 20 that is a latent image forming unit, to be described later, and comes to hold a Y electrostatic latent image.

Figure 5:
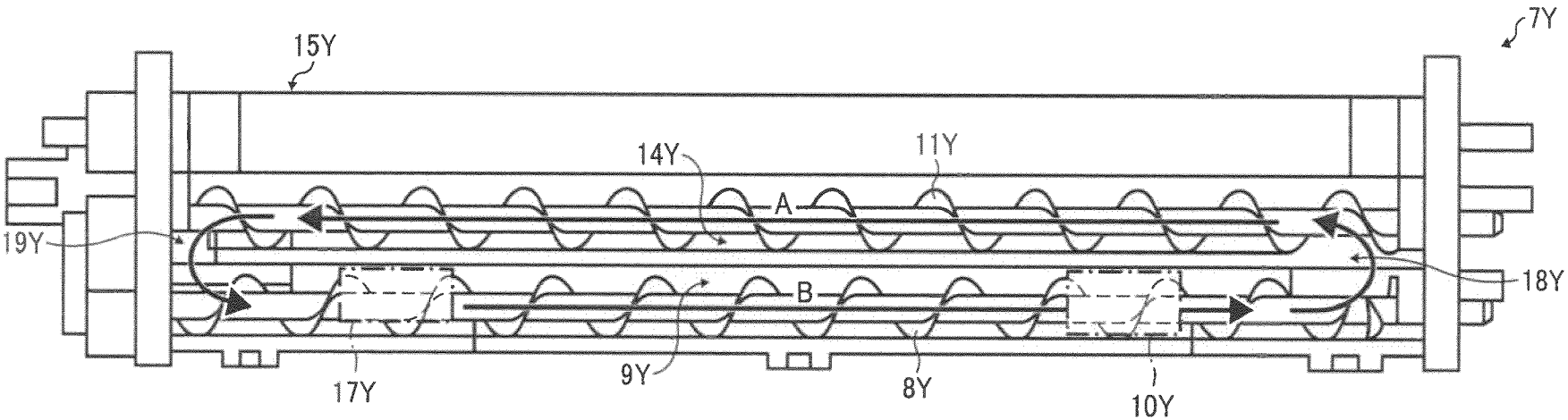
FIG. 5 is a disassembled plan view of a developing unit included in the processing unit shown in FIG. 3.

FIG. 5 is a disassembled view of the developing unit 7Y, indicating inside thereof. As shown in FIGS. 3 and 5, the developing unit 7Y as a developing means includes a first developer container 9Y in which a first conveyor screw 8Y is installed as a developer conveying unit. The developing unit 7Y also includes a second developer container 14Y having a toner concentration sensor 10Y as a toner concentration detecting means that is a permeability sensor; a second conveyor screw 11Y as a developer conveying means; a developing roll 12Y as a developer holding body; and a doctor blade 13Y that is a developer controlling member. These two developer containers that form a circulation channel contain Y developer, not shown, that is a two-component developer including magnetic carrier and negatively-charged Y toner. The first conveyor screw 8Y is caused to be driven to rotate by a driving unit, not shown, to convey the Y developer contained in the first developer container 9Y toward the front side in FIG. 3 (in the direction shown by the arrow in FIG. 5). While the Y developer is being conveyed, the toner concentration sensor 10Y, fixed above the first conveyor screw 8Y, detects the concentration of the toner in the Y developer passing a predetermined detection point located downstream of the area facing a toner supplying opening 17Y (hereinafter, "supply area") in the first developer container 9Y along the direction of circulation of the developer. The Y developer that is conveyed to the end of the first developer container 9Y by way of the first conveyor screw 8Y travels through a connected opening 18Y, and enters the second developer container 14Y.

The second conveyor screw 11Y in the second developer container 14Y is driven to rotate by a driving unit, not shown, toward the rear side in FIG. 3 (in the direction shown by the arrow A in FIG. 5). Above the second conveyor screw 11Y, as shown in FIG. 3, conveying the Y developer in the manner described above, the developing roll 12Y is arranged in parallel to the second conveyor screw 11Y. The developing roll 12Y includes a magnet roller 16Y on which a developing sleeve 15Y is fixed. The developing sleeve 15Y is a non-magnetic sleeve that is driven to rotate in the counter-clockwise direction in FIG. 3. A part of the Y developer conveyed by way of the second conveyor screw 11Y is brought to the surface of the developing sleeve 15Y by way of magnetic force generated from the magnet roller 16Y. The thickness of the Y developer layer is controlled by the doctor blade 13Y arranged so as to maintain a predetermined gap with respect to the surface of the developing sleeve 15Y. The Y developer is thus conveyed to a developing area facing the photoconductor 3Y, and becomes attached to the Y electrostatic latent image on the photoconductor 3Y. By way of this attachment of the Y toner, a Y toner image is formed on the photoconductor 3Y. The Y developer, whose Y toner is consumed in the development, is returned to the second conveyor screw 11Y along the rotation of the developing sleeve 15Y. The Y developer is then conveyed to the end of the second developer container 14Y by way of the second conveyor screw 11Y, and returned to the first developer container 9Y through a connected opening 19Y. In this manner, the Y developer is conveyed in the circulating manner in the developing unit 7Y.

Figure 6:
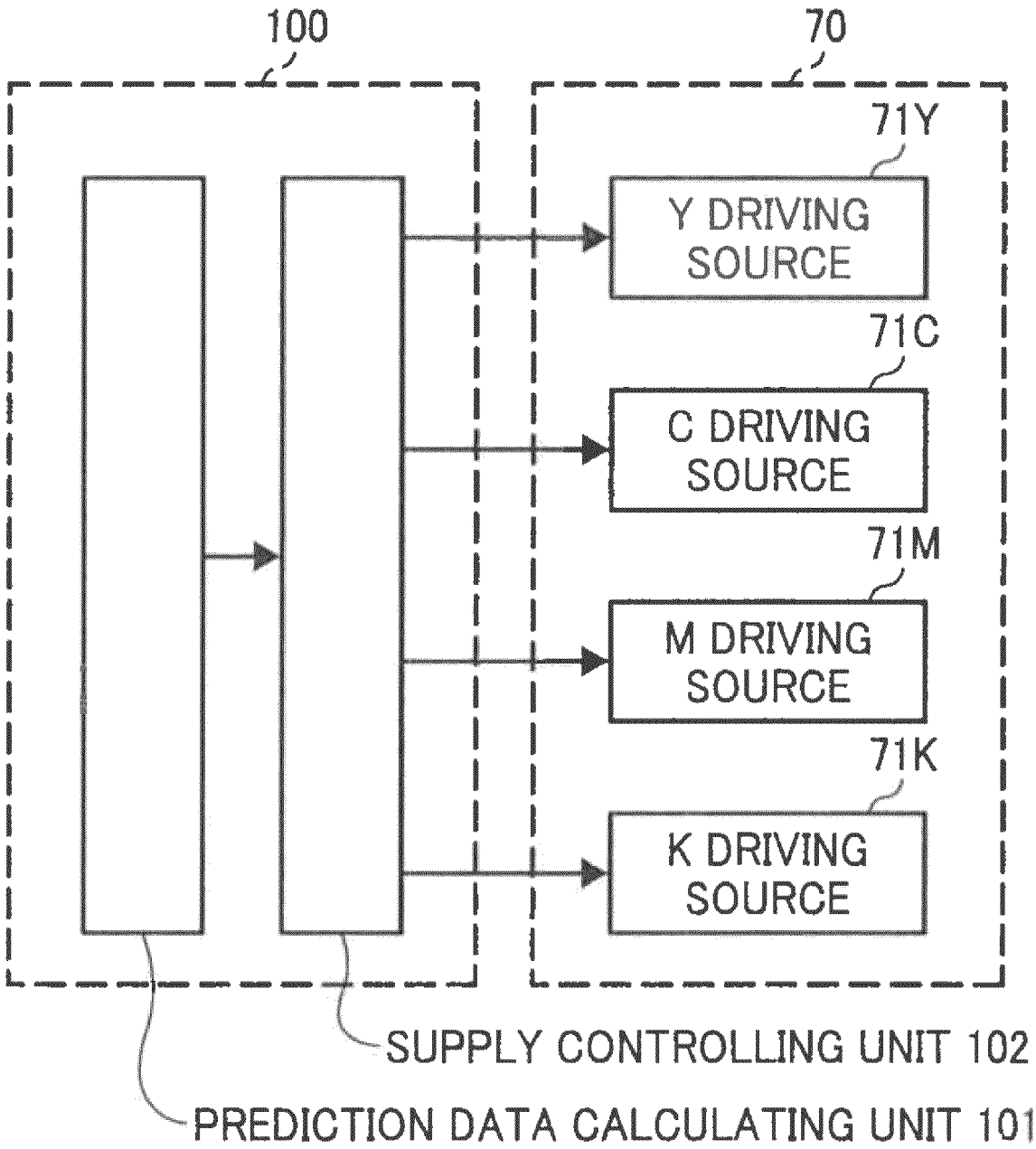
FIG. 6 is a block diagram of a part of an electrical circuit included in the printer.

FIG. 6 is a block diagram of a part of an electrical circuit in the printer. A detection result of the toner concentration in the Y developer, detected by the toner concentration sensor 10Y, is sent to a controlling unit 100 as an electrical signal. The controlling unit 100 includes a central processing unit (CPU) that is an operating unit, a random access memory (RAM) and a read-only memory (ROM) that are data storage units, for example. The controlling unit 100 is able to perform various operations and execute control programs. The controlling unit 100 stores in the RAM the data of a Y target voltage Vtref. The Y target voltage Vtref is a target value for a voltage from the toner concentration sensor 10Y. The controlling unit 100 also stores therein data of C, M, and K target voltages Vtref. The C, M, and K target voltages Vtref are target values for the voltages output from toner concentration sensors installed in the other developing units 7C, 7M, and 7K. For the Y developing unit 7Y, the output voltage from the toner concentration sensor 10Y is compared with the Y target voltage Vtref to control a driving source 71Y in a toner supplying unit 70 for Y, so that the Y toner is supplied through the toner supplying opening 17Y in an amount obtained from the comparison result. By way of this control, an appropriate amount of the Y toner is supplied to the Y developer whose Y toner concentration reduces while the Y toner is consumed in a development process, in the first developer container 9Y. Therefore, the toner concentration in the Y developer is maintained within a target range of the toner concentration in the second developer container 14Y. The same can be said for the developers of other colors in the developing units 7C, 7M, and 7K. A toner supplying control according to the embodiment is performed so as to eliminate the unevenness in the toner concentration; however, the detailed explanation thereof will be provided later.

In FIG. 2 mentioned earlier, the Y toner image formed on the photoconductor 3Y is intermediarily transferred to an intermediate transfer belt 41 that is an intermediate transfer body. The drum cleaning unit 4Y in the photoconductor unit 2Y removes the toner remaining on the surface of the photoconductor 3Y after the intermediate transfer process. The surface of the photoconductor 3Y, cleaned in the manner described above, is neutralized by a neutralizing unit that is not shown. By way of this neutralization, the surface of the photoconductor 3Y is initialized, and is prepared for the next image forming process. In the same manner, in the processing units 1C, 1M, and 1K of the other colors, a C toner image, an M toner image, and a K toner image are formed on photoconductors 3C, 3M, and 3K, respectively, and intermediarily transferred onto the intermediate transfer belt 41.

Figure 1:
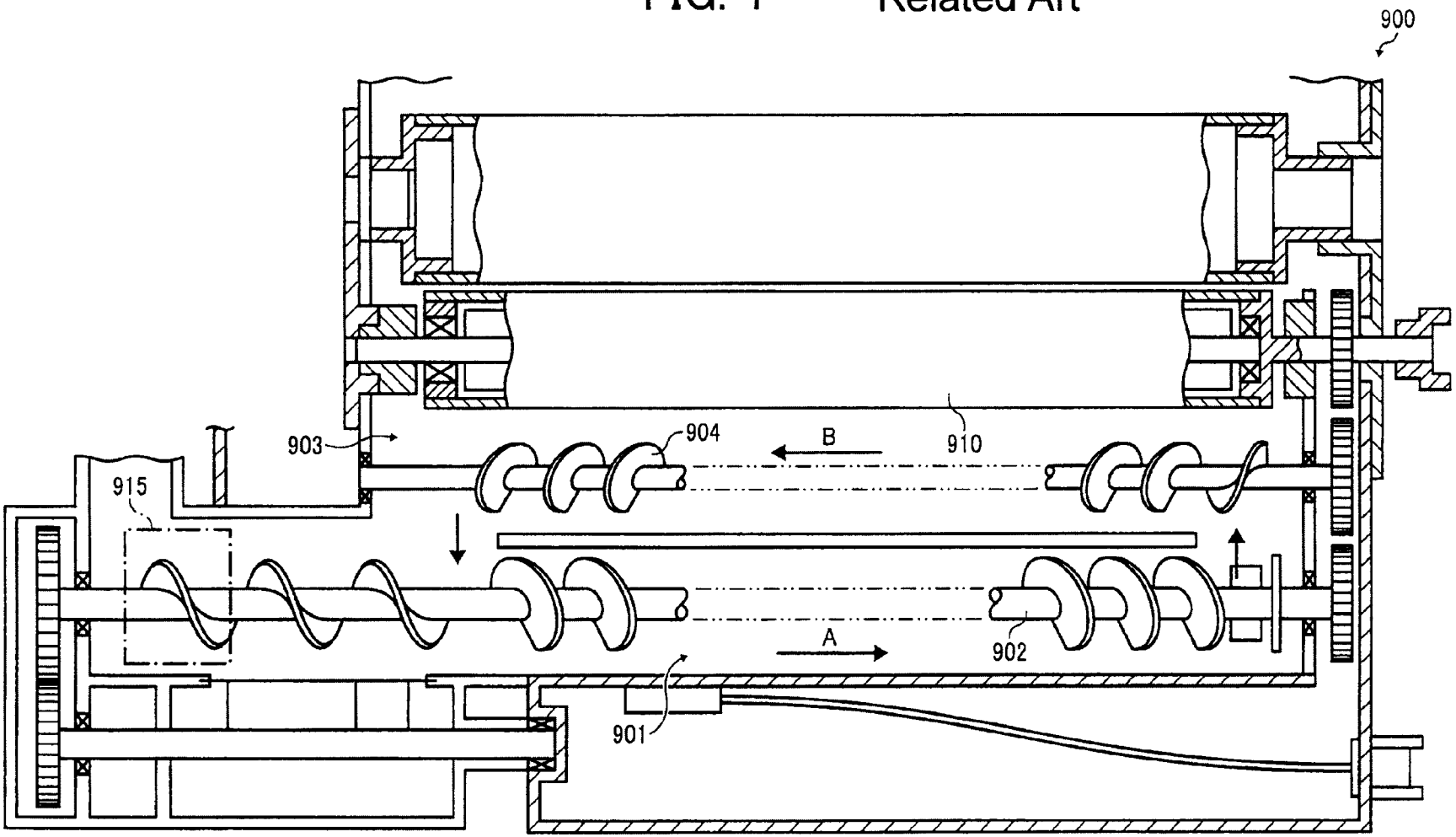
FIG. 1 Related Art
FIG. 1 is a schematic diagram of a developing apparatus disclosed in Japanese Patent Application Laid-open No. H9-160364.

The optical writing unit 20 is provided under the processing units 1Y, 1C, 1M, and 1K in FIG. 1. The optical writing unit 20 irradiates the photoconductors 3Y, 3C, 3M, and 3K in the processing units 1Y, 1C, 1M, and 1K with a laser beam L emitted based on image information. In this manner, the Y, C, M, and K electrostatic latent images are formed on the photoconductors 3Y, 3C, 3M, and 3K, respectively. The optical writing unit 20 causes the laser beam L, emitted from a light source, to be deflected by way of a polygon mirror 21 that is driven to rotate by a motor, to irradiate the photoconductors 3Y, 3C, 3M, and 3K therewith. Instead of this structure, a structure with an LED array may be alternatively used.

A first paper feeding cassette 31 and a second paper feeding cassette 32 are arranged under the optical writing unit 20, stacked on top of each other in the portrait direction. Recording paper sheets P, each of which is a recording medium, are held in each of the paper feeding cassettes as in a bundle of stacked recording papers. A first paper feeding roller 31*a* and a second paper feeding roller 32*a* are in contact with the recording paper sheets P placed at a top of the bundle. When the first paper feeding roller 31*a* is driven to rotate in the counter-clockwise direction in FIG. 1 by a driving unit not shown, the recording paper sheet P located at the top in the first paper feeding cassette 31 is ejected to a paper feeding channel 33 that extends in the portrait direction at the right side of the cassettes in FIG. 1. In the same manner, when the second paper feeding roller 32*a* is driven to rotate in the counter-clockwise direction in FIG. 1 by a driving unit not shown, the recording paper sheet P located at the top in the second paper feeding cassette 32 is ejected to the paper feeding channel 33. A plurality of pairs of conveying rollers 34 are arranged along the paper feeding channel 33, and the recording paper sheet P fed into the paper feeding channel 33 is conveyed from the bottom to the top of FIG. 1 along the paper feeding channel 33, nipped between the conveying roller pairs 34. A pair of resist rollers 35 is arranged at an end of the paper feeding channel 33. As soon as the resist roller pair 35 nips the recording paper sheet P fed by the conveying roller pair 34, the rotation of the resist roller pair 35 is once stopped. Then, the resist roller pair 35 sends the recording paper sheet P to the secondary transferring nip, to be described later, at an appropriate timing.

A transferring unit 40 is arranged above the processing units 1Y, 1C, 1M, and 1K in FIG. 2, to stretch, hold, and move the intermediate transfer belt 41 endlessly in the counter-clockwise direction in FIG. 1. The transferring unit 40 includes, in addition to the intermediate transfer belt 41, a belt cleaning unit, a first bracket, and a second bracket. The transferring unit 40 also includes four primary transfer rollers 45Y, 45C, 45M, and 45K, a secondary transfer backup roller 46, a driving roller 47, an auxiliary roller, and a tension roller 49. The intermediate transfer belt 41 is stretched over these rollers, and moved endlessly in the counter-clockwise direction in FIG. 2, by way of driving rotation of the driving roller 47. Each of the four primary transfer rollers 45Y, 45C, 45M, and 45K nips the intermediate transfer belt 41, moving endlessly as mentioned above, together with the photoconductors 3Y, 3C, 3M, and 3K, respectively, forming primary transferring nips. A transfer bias having a polarity (a plus in the embodiment) opposite to that of the toner is applied to the internal surface of the intermediate transfer belt 41. While the intermediate transfer belt 41 sequentially goes through the Y, C, M, and K primary transferring nips while the intermediate transfer belt 41 moves endlessly, a toner image of each of the colors, formed on each of the photoconductors 3Y, 3C, 3M, and 3K, are primarily transferred to the external surface of the intermediate transfer belt 41, with each of the images overlapped with the others. In this manner, the four overlapping toner images (hereinafter, "four-colored toner image") are formed on the intermediate transfer belt 41.

The secondary transfer backup roller 46 nips the intermediate transfer belt 41 with a secondary transfer roller 50 arranged outside of the loop of the intermediate transfer belt 41, forming a secondary transferring nip. The resist roller pair 35, explained earlier, sends the recording paper sheet P, nipped therebetween, into the secondary transferring nip at a timing synchronized with the arrival of the four-colored toner image on the intermediate transfer belt 41. The four-colored toner image on the intermediate transfer belt 41 is secondarily transferred onto the recording paper sheet P altogether at the secondary transferring nip by way of nipping pressure and a secondary transfer electrical field generated between the secondary transfer roller 50 and the secondary transfer backup roller 46 to which a secondary transfer bias is applied. Along with the white color of the recording paper sheet P, a full-colored toner image is obtained.

Residual toner, not transferred onto the recording paper sheet P, remains attached on the intermediate transfer belt 41 even after going through the transfer process at the secondary transferring nip. The belt cleaning unit cleans this residual toner. The belt cleaning unit includes a cleaning blade that is held in contact with the front surface of the intermediate transfer belt 41, and removes the residual toner by wiping the residual toner therewith.

The first bracket in the transferring unit 40 slides in a predetermined rotation angle around the rotation axis of the auxiliary roller when the driving of a solenoid, not shown, is turned ON and OFF. Upon forming a monochromatic image, the printer according to the embodiment drives the solenoid to cause the first bracket to rotate slightly in the counter-clockwise direction in FIG. 2. By way of this rotation, the Y, C, and M primary transfer rollers 45Y, 45C, 45M are caused to rotate in the counter-clockwise direction in FIG. 2 around the rotation axis of the auxiliary roller to move the intermediate transfer belt 41 away from the Y, C, and M photoconductors 3Y, 3C, and 3M. Upon forming a monochromatic image, out of four of the processing units 1Y, 1C, 1M, and 1K, only the K processing unit 1K is driven. In this manner, the Y, C, M processing units are not wastefully driven upon forming a monochromatic image, thus preventing these processing units from being worn out due to such wasteful operation.

A fixing unit 60 as a fixing means is provided above the secondary transferring nip in FIG. 2. The fixing unit 60 includes a pressing and heating roller 61 having a heat source such as a halogen lamp, and a fixing belt unit 62. The fixing belt unit 62 further includes a fixing belt 64, a heating roller 63 having a heat source such as a halogen lamp, a tension roller 65, a driving roller 66, and a temperature sensor that is not shown. The endless fixing belt 64 is stretched over the heating roller 63, the tension roller 65, and the driving roller 66, and caused to move endlessly in the counter-clockwise direction in FIG. 2. While moving endlessly, the rear side of the fixing belt 64 is heated by the heating roller 63. The pressing and heating roller 61, driven to rotate in the clockwise direction in FIG. 2, is kept in contact with the front surface of the fixing belt 64 thus heated, at the area where the fixing belt 64 is stretched over the heating roller 63. A fixing nip is formed where the pressing and heating roller 61 and the fixing belt 64 touch each other.

Outside of the loop of the fixing belt 64, a temperature sensor, not shown, is arranged facing the front surface of the fixing belt 64 with a predetermined gap therewith to detect the temperature at the surface of the fixing belt 64 right before going into the fixing nip. The result of this detection is sent to a fixer power circuit that is not shown. The fixer power circuit controls ON and OFF of the power to be supplied to the heat source included in the heating roller 63 or one included in the pressing and heating roller 61, based on the detection result of the temperature sensor. In this manner, the temperature at the surface of the fixing belt 64 is maintained at approximately 140 Celsius degrees. The recording paper sheet P, having gone through the secondary transferring nip and removed from the intermediate transfer belt 41, is sent into the fixing unit 60. While the recording paper sheet P is conveyed from the bottom to the top of FIG. 1, nipped by the fixing nip in the fixing unit 60, the recording paper sheet P is heated and pressed, and the full-colored toner image is fixed onto the recording paper sheet P.

The recording paper sheet P, thus applied with the fixing process, is ejected outside of the printer after being passed through the rollers of a pair of paper ejecting rollers 67. A stacking unit 68 is provided on the top surface of the chassis of the printer. The recording paper sheet P, ejected by the pair of paper ejecting rollers 67, is stacked sequentially on the stacking unit 68.

Above the transferring unit 40, four containers for toner, toner bottles 72Y, 72C, 72M, and 72K, are provided. These toner bottles 72Y, 72C, 72M, and 72K store therein Y toner, C toner, M toner, and K toner, respectively. The toner of each of the colors, contained in each of the toner bottles 72Y, 72C, 72M, and 72K, is supplied to the developing units 7Y, 7C, 7M, and 7K, included in the processing units 1Y, 10, 1M, and 1K, respectively, by way of the toner supplying unit 70. The toner bottles 72Y, 72C, 72M, and 72K can be removed from and attached to the printer independently from the processing units 1Y, 10, 1M, and 1K.

As already shown in FIG. 5, the toner concentration sensor 10Y detects the toner concentration in the developer in the first developer container 9Y that is a non-supply area, right before entering the second developer container 14Y that is a supply area. The toner supplying opening 17Y is arranged to supply toner to the developer right after entering the first developer container 9Y from the second developer container 14Y. In other words, in the first developer container 9Y, the toner concentration sensor 10Y detects the concentration of the toner in the developer at a position downstream of the toner supplying opening 17Y.

Figure 7:
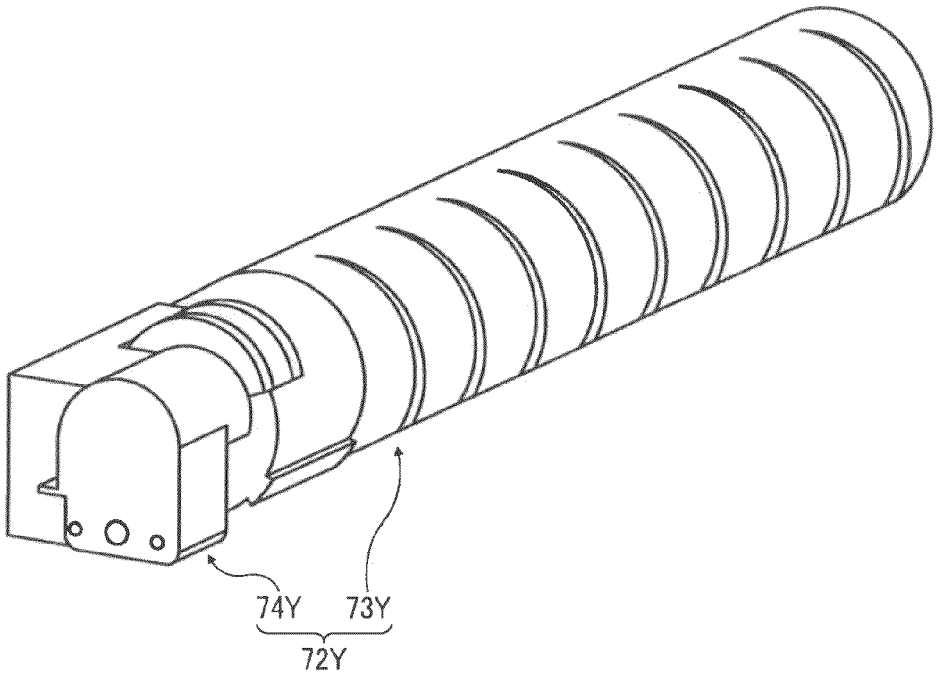
FIG. 7 is a perspective view of a toner bottle for Y.
Figure 8:
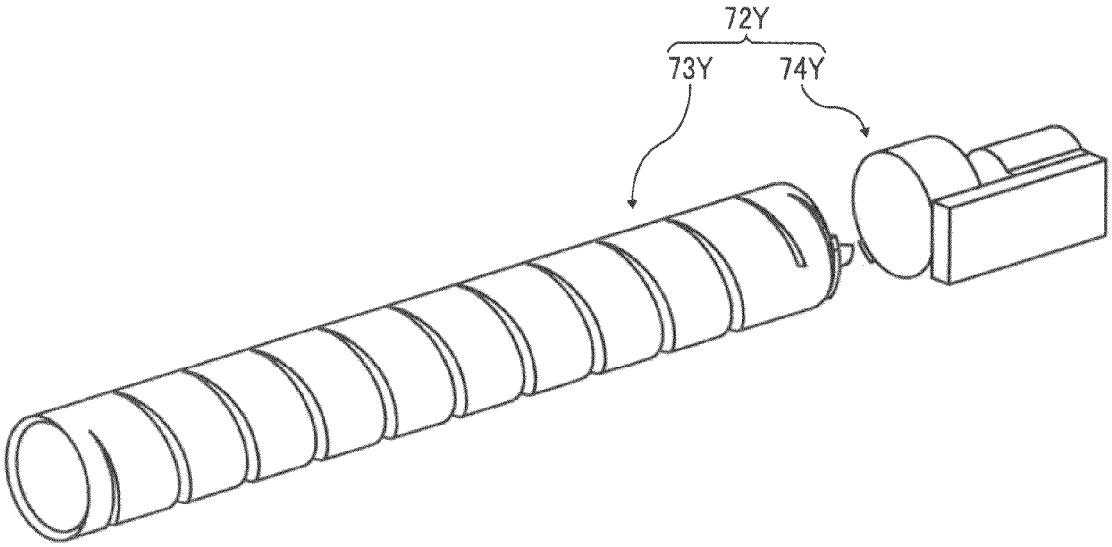
FIG. 8 is a perspective view of the toner bottle, shown in FIG. 7, disassembled into a bottle unit and a holder unit.

FIG. 7 is a perspective view of the Y toner bottle 72Y. In FIG. 7, the Y toner bottle 72Y includes a bottle-shaped bottle unit 73Y as a powder containing unit that contains the Y toner in a powder form, and a cylinder-shaped holder unit 74Y as a powder ejecting unit. As shown in FIG. 8, the holder unit 74Y is engaged with the top of the bottle-shaped bottle unit 73Y, holding the bottle unit 73Y in a rotatable manner. On the inner circumference of the bottle unit 73Y, a screw-like, spiral shaped protrusion, protruding toward the inside of the container from outside thereof, is formed in an extending manner along the axis line of the Y toner bottle 72Y.

Figure 9:
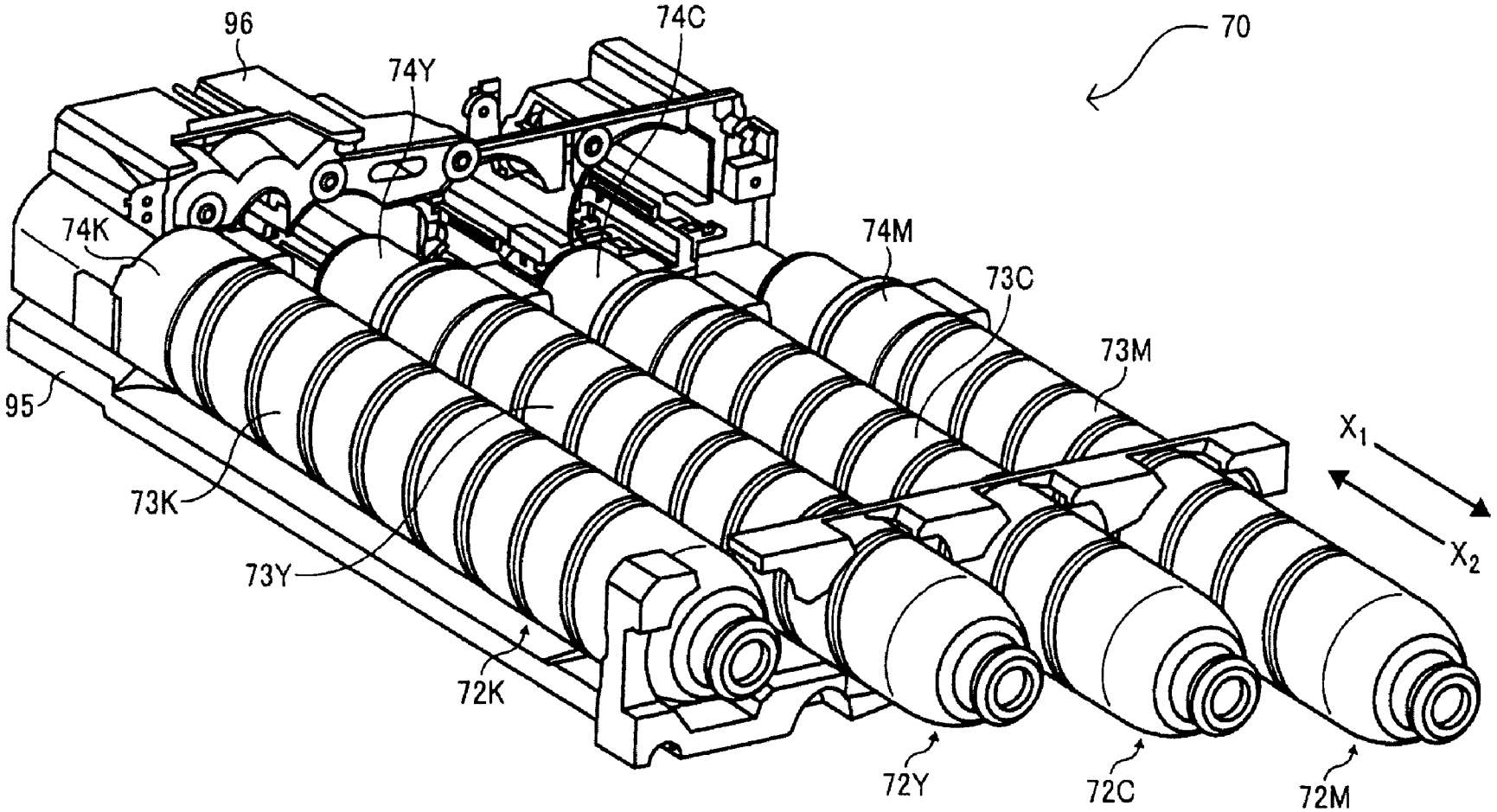
FIG. 9 is a perspective view of a toner supplying unit included in the printer.

FIG. 9 is a perspective view of the toner supplying unit 70 included in the printer. In FIG. 9, the toner supplying unit 70 as a toner supplying means includes a bottle-placing platform 95 for placing the four toner bottles 72K, 72Y, 72C, and 72M thereon, and a bottle driving unit 96 that individually drives each of the bottle units 73K, 73Y, 73C, 73M to rotate. Each of the toner bottles 72K, 72Y, 72C, and 72M placed on the bottle-placing platform 95 has a holder that is engaged with the bottle driving unit 96. By sliding the toner bottle 72M away from the bottle driving unit 96 on the bottle-placing platform 95, as shown by arrow X1 in FIG. 9, the toner bottle 72M engaged at a holder 74M with the bottle driving unit 96 can be removed from the bottle driving unit 96. In this manner, the toner bottle 72M can be removed from the toner supplying unit 70. Furthermore, by sliding the toner bottle 72M toward the bottle driving unit 96 on the bottle-placing platform 95 as shown by the arrow X2 in FIG. 9 when the toner bottle 72M is not attached to the toner supplying unit 70, the toner bottle 72M can be engaged to the bottle driving unit 96 at the holder 74M. In this manner, the toner bottle 72M can be attached to the toner supplying unit 70. The same operation can be performed to remove or attach the toner bottles 72K, 72Y, and 72C of the other colors from or to the toner supplying unit 70.

A gear, not shown, is formed on each of the outer circumference of the tip of bottle units 73K, 73Y, 73C, and 73M in the toner bottles 72Y, 72C, 72M, and 72K. These gears are covered by the holder units 74K, 74Y, 74C, and 74M. To expose a gear partially, a cutout, not shown, is formed on a part of the circumference of the holder units 74K, 74Y, 74C, and 74M. In this manner, a part of the gear is exposed therefrom. When the holder units 74K, 74Y, 74C, and 74M of the toner bottles 72K, 72Y, 72C, and 72M are engaged with the bottle driving unit 96, K, Y, C, and M bottle driving gears, not shown, provided on the bottle driving unit 96 are engaged with the gears on the bottle unit 73K, 73Y, 73C, and 73M, respectively, through the cutouts. The K, Y, C, and M bottle driving gears on the bottle driving unit 96 are driven to rotate by a driving system not shown, further to drive the bottle units 73K, 73Y, 73C, and 73M to rotate in the holder units 74K, 74Y, 74C, and 74M.

In FIG. 7 mentioned earlier, when the bottle unit 73Y is caused to rotate in the holder unit 74Y, the Y toner moves from the bottom to the top of the bottle unit 73Y, along the screw-shaped, spiral protrusion formed in the bottle unit 73Y. The Y toner then enters the cylinder-shaped holder unit 74Y through a bottle opening, not shown, provided at the tip of the bottle unit 73Y that is the powder containing unit.

Figure 10:
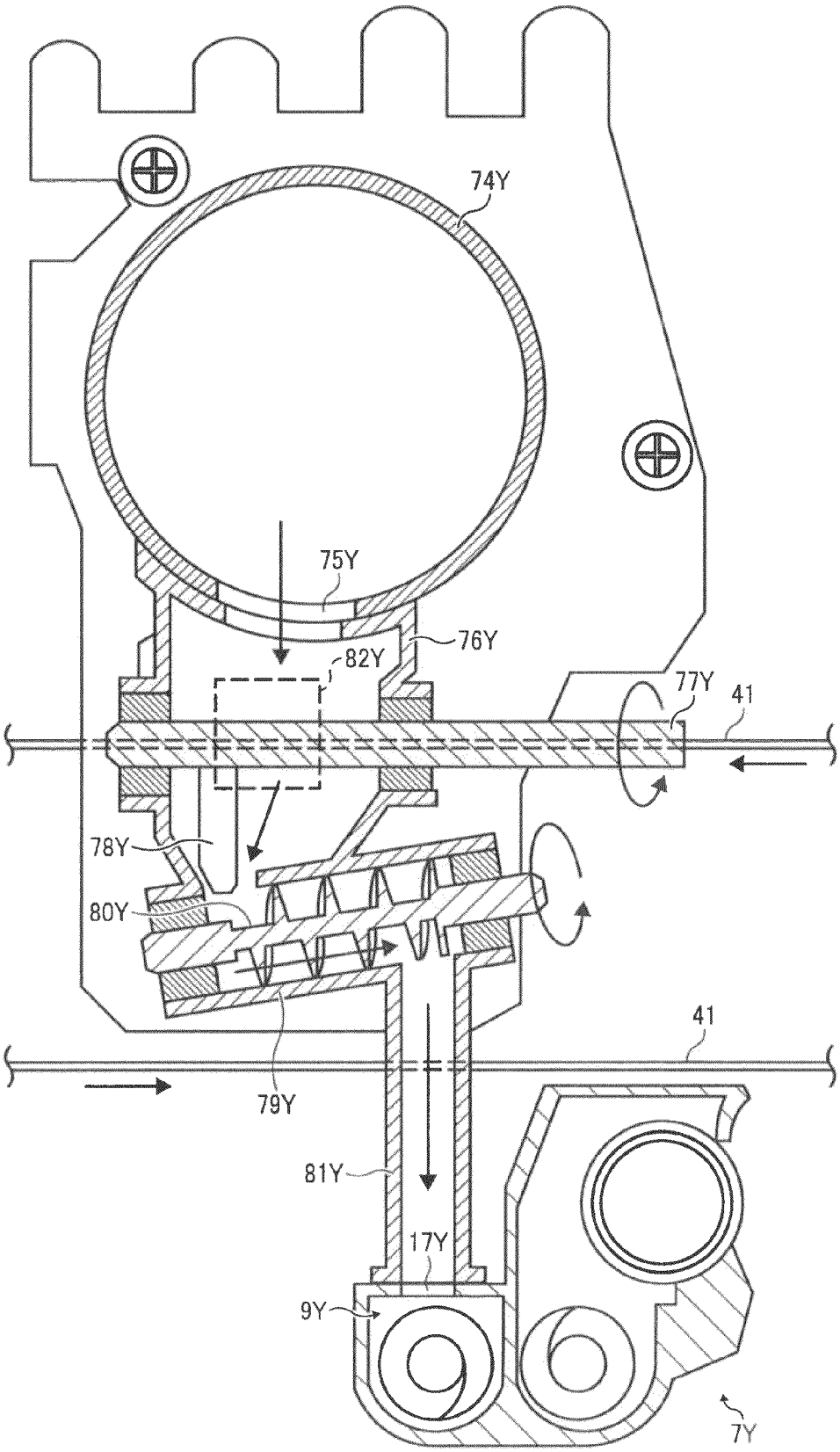
FIG. 10 is a schematic diagram of the toner bottle, shown in FIG. 7, attached to the toner supplying unit shown in FIG. 9, and peripheral structures therearound.

FIG. 10 is a schematic diagram of the toner bottle attached to the toner supplying unit, not shown, and structures therearound. FIG. 10 is a cross section of the toner bottle that is cut across the holder unit 74Y. As mentioned already, when the bottle unit, not shown, provided behind the holder unit 74Y in FIG. 10, is driven to rotate, the Y toner in the bottle unit is sent into the holder unit 74Y. The holder unit 74Y of the toner bottle is engaged with a hopper 76Y on the toner supplying unit. The hopper 76Y has a flat shape along a direction perpendicular to the surface of the drawing. In FIG. 10, the hopper 76Y is located in front of the intermediate transfer belt 41. A toner ejecting opening 75Y formed at the bottom of the holder unit 74Y is communicatively connected to the toner receiving opening formed on the hopper 76Y in the toner supplying unit. The Y toner, sent into the holder unit 74Y from the bottle unit 73Y of the toner bottle, is dropped into the hopper 76Y by way of its own weight. In the hopper 76Y, a flexible pressing film 78Y, fixed onto a rotatable rotating shaft member 77Y, rotates together with the rotating shaft member 77Y. A toner detecting sensor 82Y is fixed on the inner wall of the hopper 76Y. The toner detecting sensor is a piezoelectric device that detects the presence of toner in the hopper 76Y. The pressing film 78Y is made of, for example, a polyethylene terephthalate (PET) film, and presses the Y toner against a detection surface of the toner detecting sensor 82Y along the rotation thereof. In this manner, the toner detecting sensor 82Y can detect the Y toner in the hopper 76Y reliably. The bottle unit 73Y of the toner bottle is controlled to be driven to rotate so that the toner detecting sensor 82Y can detect the Y toner reliably. Therefore, as long as sufficient toner is in the bottle unit 73Y, a sufficient amount of the Y toner drops into the hopper 76Y through the holder unit 74Y from the bottle unit 73Y, filling the hopper 76Y with a sufficient amount of the Y toner. In this condition, when the toner detecting sensor 82Y comes to detect a less amount of the Y toner although the bottle unit 73Y is rotated frequently, a controlling unit, not shown, considers that a very small amount of the remaining toner is available in the bottle unit 73Y, and provides a user with a "toner near-end" alarm.

A lateral conveying pipe 79Y is connected to the bottom of the hopper 76Y. The Y toner in the hopper 76Y slides along a taper formed thereon by way of its own weight, dropping into the lateral conveying pipe 79Y. A toner supplying screw 80Y is provided in the lateral conveying pipe 79Y, and along the driving rotation thereof, the Y toner is conveyed laterally along the longitudinal direction of the lateral conveying pipe 79Y.

A drop guiding pipe 81Y is connected to a longitudinal end of the lateral conveying pipe 79Y, in an extending manner along the portrait direction. The bottom end of the drop guiding pipe 81Y is connected to the toner supplying opening 17Y, provided on the first developer container 9Y of the developing unit 7Y. When the toner supplying screw 80Y, installed in the lateral conveying pipe 79Y, is rotated, the Y toner, conveyed to the longitudinal end of the lateral conveying pipe 79Y, is dropped into the first developer container 9Y in the developing unit 7Y through the drop guiding pipe 81Y and the toner supplying opening 17Y. In this manner, the Y toner is supplied to the first developer container 9Y. Moreover, the toners of the other colors (C, M, and K) are supplied in the same manner.

Figure 11:
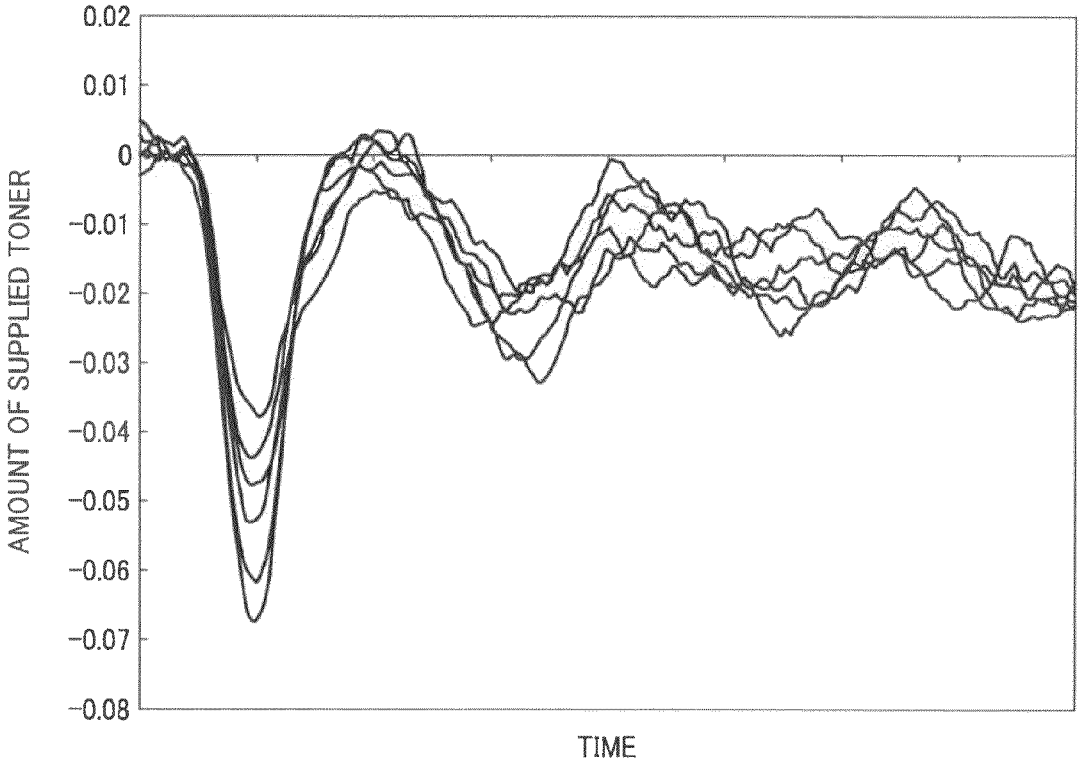
FIG. 11 is a graph having waveforms of the amount of toner supplied in a single toner supply operation, overlapped with one another, when the same toner supply operation is repeated.
Figure 12:
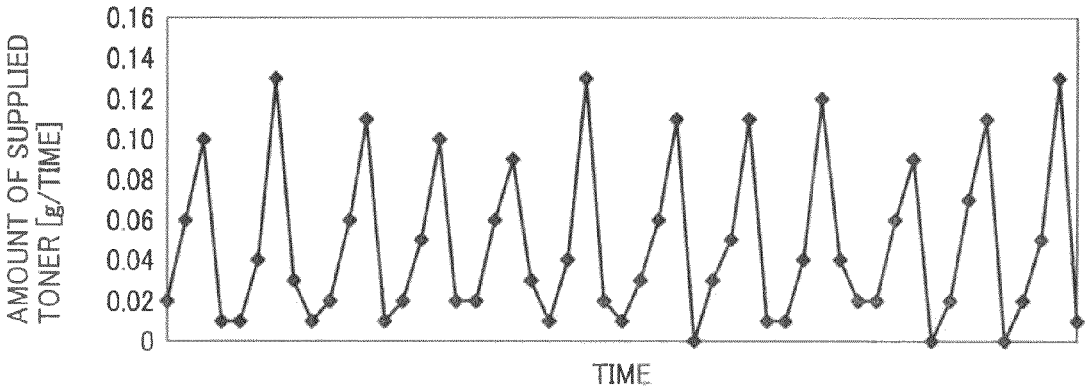
FIG. 12 is a graph of a relationship between the number of the times a toner supplying screw, included in the toner supplying unit shown in FIG. 9, is rotated, and the amount of toner supplied in a single rotation.

According to the structure where the toner is supplied by way of the driving rotation of the toner supplying screw 80Y as described above, a supply resolution is not very high. FIG. 11 is a graph having waveforms of the amount of toner supplied in a single toner supply operation, overlapped with one another, when the same toner supply operation is repeated. As shown in FIG. 11, it can be seen that, although the same toner supply operation is repeated, the amount of supplied toner varies greatly. The shorter the length of the supply operation is, the more prominent the variation in the amount of supplied toner becomes. The amount of supplied toner can change in a certain cycle. For example, FIG. 12 is a graph of a relationship between the number of the times the toner supplying screw 80Y is rotated, and the amount of toner supplied in a single rotation. In this graph, in every four time the screw is rotated, the amount of supplied toner primarily indicates a great increase.

In response to this issue, in the printer according to the embodiment, a lower limit B is set to the length of time the toner supplying unit is driven, and the driving of the toner supplying unit is turned ON or OFF following a condition for ensuring the driven time to be longer than the lower limit B. By supplying toner in this manner, the variations in the amount of supplied toner in a supply operation can be suppressed. A specific method of setting the lower limit B will be explained later in detail.

In the printer according to the embodiment, the toner supplying unit is driven at a constant speed regardless how much toner needs to be supplied in each time unit. The amount of supplied toner per time unit is adjusted by controlling the frequency of setting the drive ON and OFF. During the time a relatively large amount of toner supply is required in a time unit, the drive is turned ON and OFF frequently. On the contrary, during the time a relatively small amount of supply is required in a time unit, the drive is turned ON and OFF less frequently. If images with a high image-area ratio are successively output during the time such ON and OFF control is performed, the toner supplying unit may be kept driven for a certain length of time, as shown in an upper area of FIG. 13. However, in the printer, if such a toner supply operation is kept running for a length of time E, a toner avalanche may occur. A toner avalanche herein means a phenomenon in which a large amount of new toner is fed from the bottle unit 73Y to the hopper 76Y, shown earlier in FIG. 10, causing a large amount of air to be included between the toner particles. This increases flowability of the toner, and the toner moves through the spiral space in the toner supplying screw 80Y, installed in the lateral conveying pipe 79Y, by itself, by way of its own weight. When a toner avalanche occurs, the toner becomes supplied by itself.

Figure 13:
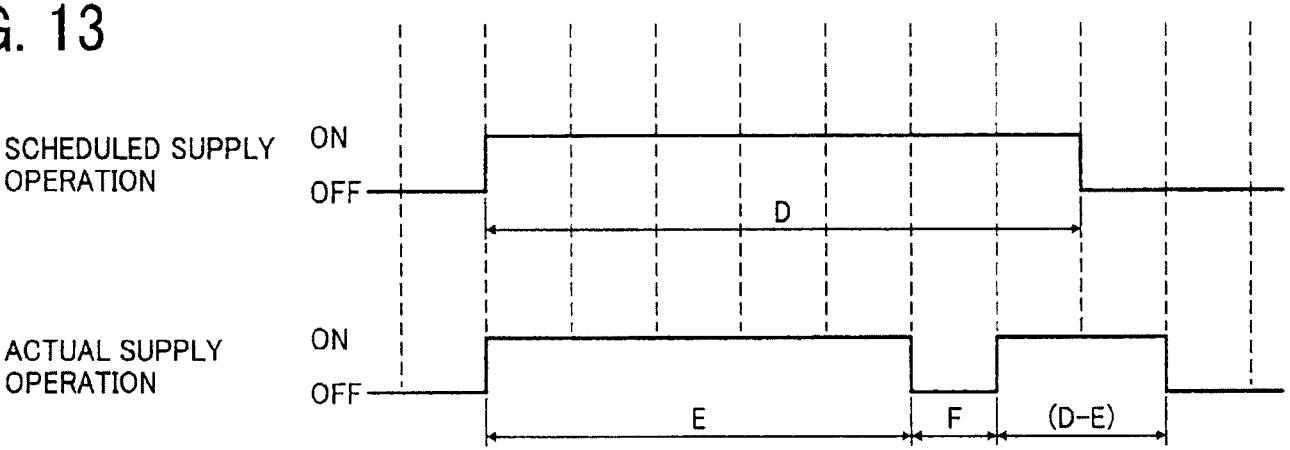
FIG. 13 is a timing chart for explaining an upper limit (E) that is set in the length of time the toner supplying unit, shown in FIG. 9, is continuously driven.

In response to this issue, in the printer according to the embodiment, an upper limit E is set to the time the supply operation is allowed to be kept running as shown in the lower diagram of FIG. 13. When the toner supplying unit is expected to be driven for a length of time that is longer than the upper limit E, the toner supplying unit is kept driven for the length of time corresponding to the upper limit E, pauses for an intermission F, and the toner supplying unit is driven again for the remaining length of time (a scheduled length of operation time D—the upper limit E). In this manner, a toner avalanche can be prevented.

Figure 14:
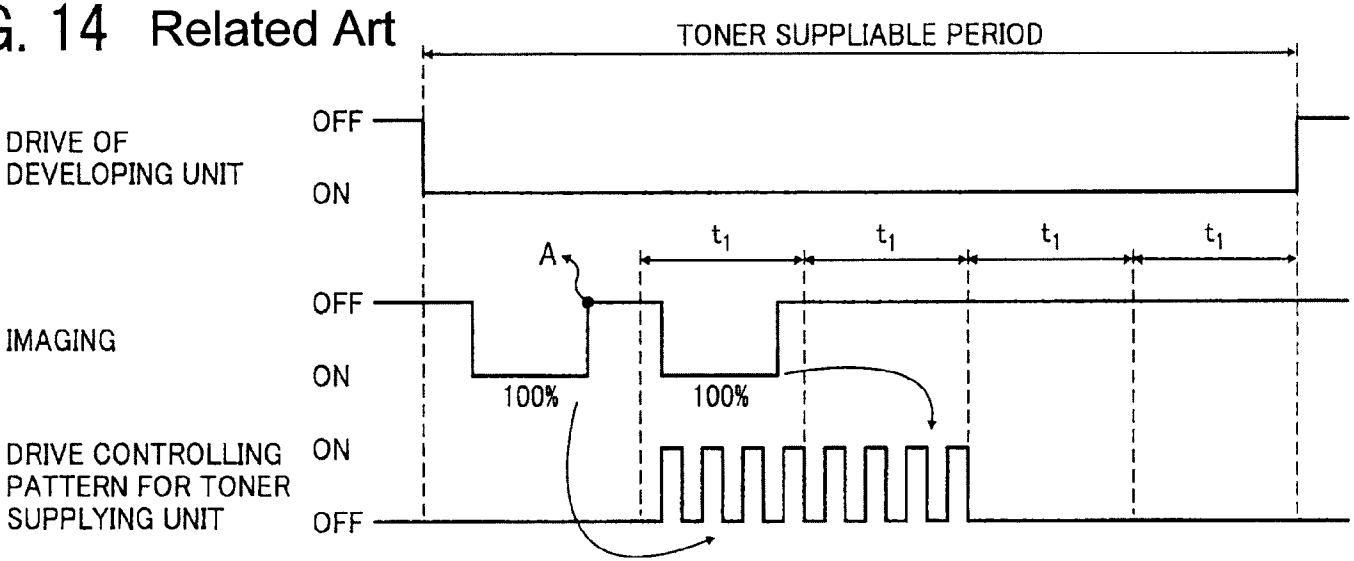
FIG. 14 Related Art
FIG. 14 is a timing chart for explaining a toner supply control performed in a conventional image forming apparatus.

A method of controlling the toner supply in a conventional image forming apparatus will now be explained. FIG. 14 is a timing chart for explaining the method of controlling the toner supply in a conventional image forming apparatus. In FIG. 14, t1 represents the time required for outputting an image onto a sheet of an A4-sized recording paper. According to the conventional method of controlling the toner supply, upon predicting the amount of toner to be consumed in an image output based on the image-area ratio of the output image of the previous page (timing A), the entire amount of the toner consumed for the previous page is supplied at once within a time period in which the next page is being output. Even if the image on the previous page is printed with the maximum output dot number (the image-area ratio=100%) in which the entire page of an A4-sized recording paper sheet is printed in flat-black, the large amount of toner consumed in the image output is supplied at once within the time period of the next page output, as shown in FIG. 14. However, a variation in toner concentration, caused by toner consumption for the previous page, persists in the first developer container 9Y for a time in which the next several pages are output. Therefore, according to the conventional method of supplying the toner, the toner is not supplied in variably so as to offset a waveform of toner concentration variation in the first developer container 9Y.

A characterizing structure of the printer according to the embodiment will now be explained.

For each page to be output, a supply controlling unit 102, included in the printer, creates a drive controlling pattern for the toner supplying unit 70, based on the image-area ratio of the output page. At this time, such a pattern is created so that the variation of toner concentration, occurring every time the page is output (the expected change in toner concentration in the developer passed through the second developer container 14Y as the supply area), is offset by changing the amount of supplied toner. To create such a drive controlling pattern, a preparatory experiment is run to actually measure a waveform of toner concentration variation that occurs when a flat-black image, having an image-area ratio of 100(%), is output, using a toner concentration sensor (such a waveform is hereinafter referred to as "reference consumption waveform"). If toner is supplied in an amount corresponding to a waveform having a phase opposite to the reference consumption waveform (hereinafter, "reference offsetting waveform"), the toner concentration variation, occurring when a flat-black image with an image-area ratio of 100(%) is output, can be completely offset. Thus, if a flat-black image having an image-area ratio of 100(%) is output, the toner concentration variation, occurring in such an output, can be completely offset by supplying the toner variably in an amount corresponding to the reference offsetting waveform. If the image-area ratio is 80%, the toner concentration variation can be offset by changing the amount of supplied toner according to a waveform having the same phase as the reference offsetting waveform, but 80% of its amplitude. To achieve this goal, an active noise control (ANC) filter circuit is prepared to convert the amplitude of the reference offsetting waveform to a height corresponding to the image-area ratio of an output image, to obtain an offsetting waveform for the image-area ratio.

Figure 15:
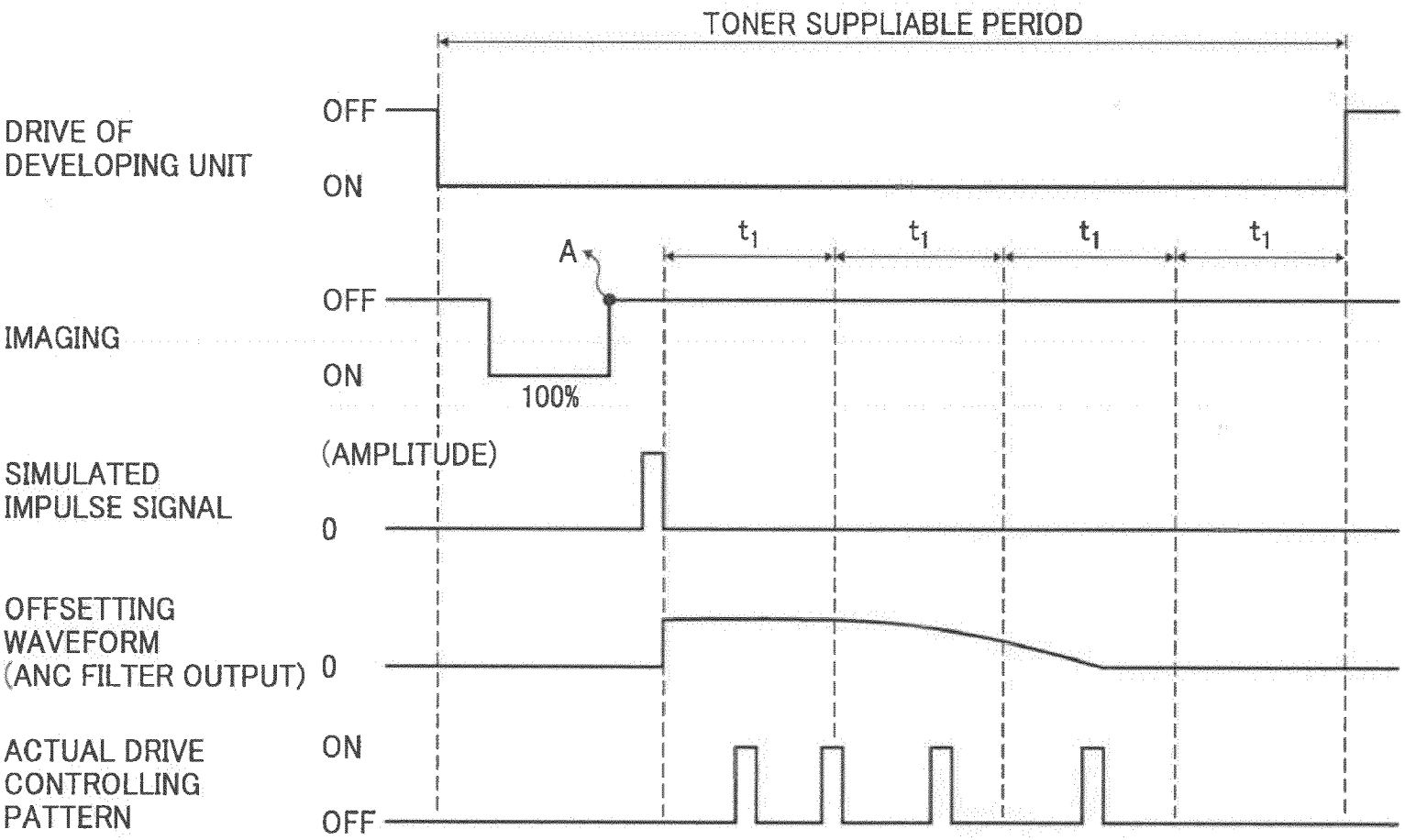
FIG. 15 is a timing chart for explaining a toner supply control performed in the printer according to the embodiment.
Figure 16:
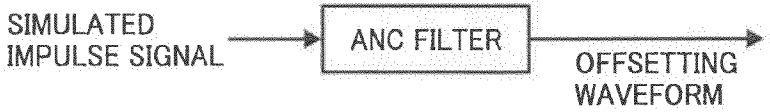
FIG. 16 is a partial block diagram of an ANC filter circuit.

FIG. 15 is a timing chart for explaining the toner supply control in the printer according to the embodiment. In FIG. 15 as well, t1 represents time required for outputting an image onto a sheet of an A4-sized recording paper. During the time the previous page is output, the supply controlling unit 102 recognizes the image-area ratio, and outputs a rectangular-shaped simulated impulse signal having a raise and a fall in a very short time period. The amplitude of the simulated impulse signal is changed according to the image-area ratio. This simulated impulse signal is passed through the ANC filter circuit to obtain an offsetting waveform that is the reference offsetting waveform whose amplitude is converted to a height corresponding to the image-area ratio (see FIG. 16). If a toner supplying unit with a high supply resolution is used, the toner supplying unit can be driven accordingly to the offsetting waveform, so that the amount of supplied toner is changed to offset the toner concentration variation completely. However, as mentioned earlier, the toner supplying unit in the printer does not have such a high supply resolution; thus, the toner supplying unit cannot be controlled to be driven exactly according to the offsetting waveform. Therefore, an integration of the offsetting waveforms is obtained, and every time the integration exceeds the lower limit B, the drive ON and OFF is raised once at the integration. Such a drive ON and OFF pattern is obtained as the drive controlling pattern. Such a drive controlling pattern is kept executed for a plurality of pages including the next page and thereafter.

Figure 17:
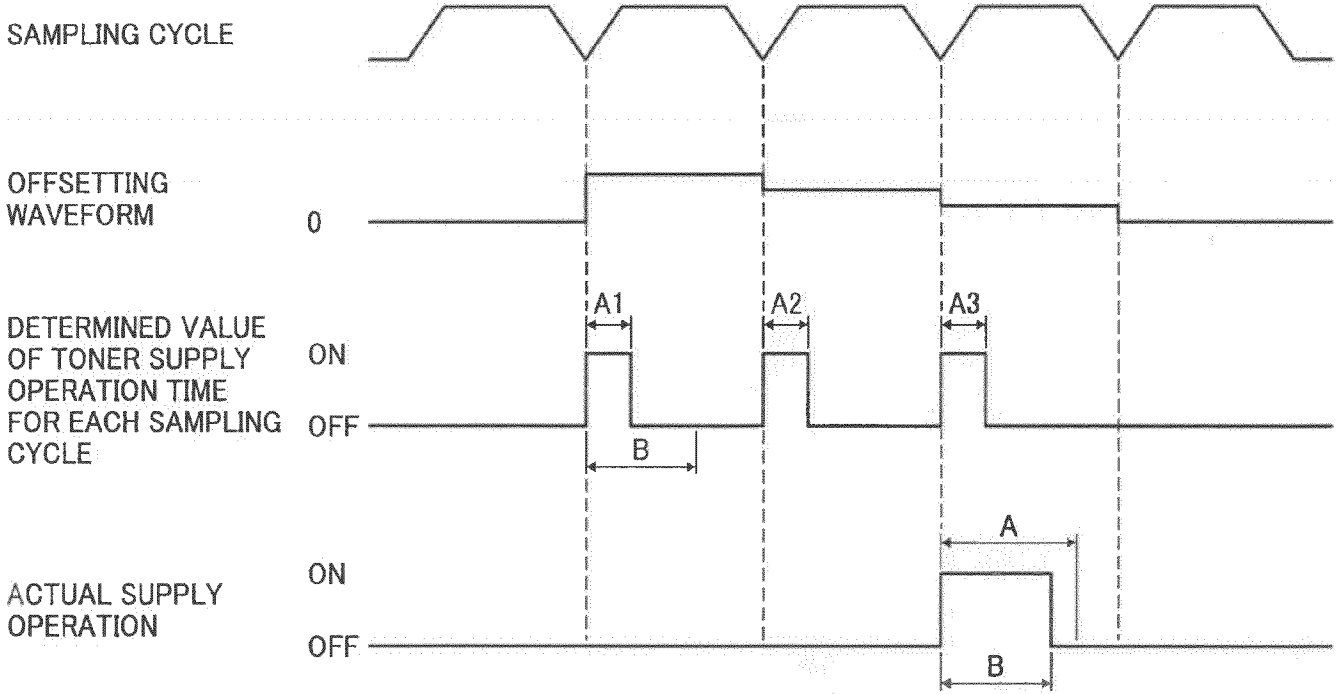
FIG. 17 is a timing chart for explaining a lower limit B that is set in the length of time the toner supplying unit, shown in FIG. 9, is driven.

FIG. 17 is a timing chart for explaining the lower limit B that is the lower limit in the length of time the toner supplying unit is driven. In FIG. 17, the supply controlling unit 102 obtains an output value Vt from the toner concentration sensor in a predetermined sampling cycle. Based on the obtained result, the offsetting waveform is output from the ANC filter circuit. Based on the offsetting waveform, the supply controlling unit sequentially determines the length of time the toner supply operation needs to be kept running for each of the sampling cycles, and the determined values are sequentially added (A1, A2, and A3). At the same time, the cumulative sum A of the determined values is compared with the lower limit B. When the cumulative sum A exceeds the lower limit B, the driving of the toner supplying unit is set ON and OFF once for a length of time equal to the drive time of the lower limit B. A drive controlling pattern is created in this manner. As described above, every time the toner supplying unit is driven, the toner supplying unit is ensured to be driven for a length of time longer than the lower limit B. Once it is determined to set driving of the toner supplying unit ON and OFF for the length of time equal to the drive time of the lower limit B, the cumulative sum A is replaced with the difference between the cumulative sum A and the lower limit B, and the cumulative sum is again calculated. In other words, the difference between the cumulative sum A and the lower limit B is carried over to the next cumulative sum.

Figure 18:
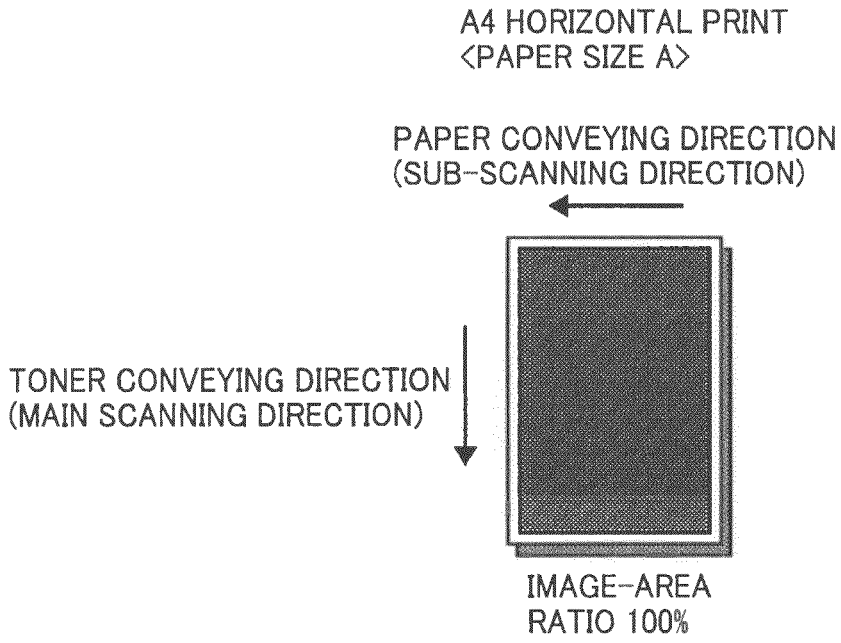
FIG. 18 is a schematic diagram of an A4-sized paper sheet on which a flat-black image is printed across the entire page thereof.
Figure 19:
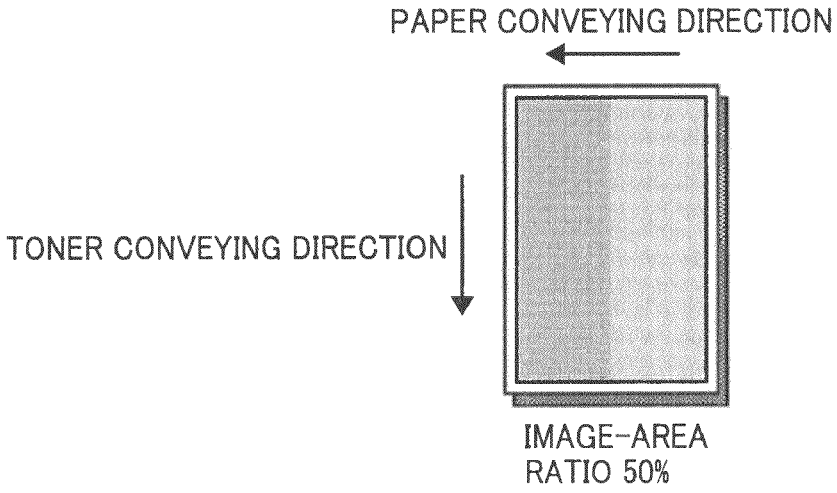
FIG. 19 is a schematic diagram of an A4-sized paper sheet on which a 50% half-tone image is printed across the entire page thereof.
Figure 20:
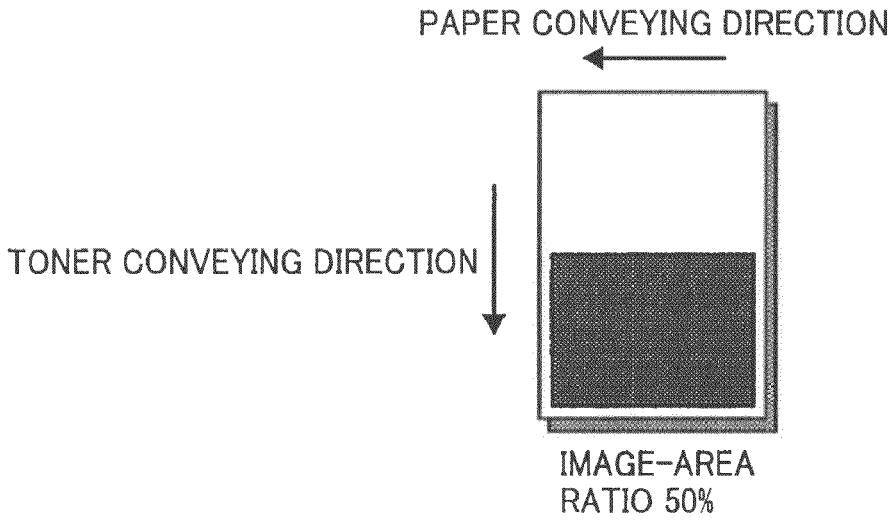
FIG. 20 is a schematic diagram of an A4-sized paper sheet on which a flat-black image is printed only on the upstream half thereof in a direction toner is conveyed.
Figure 21:
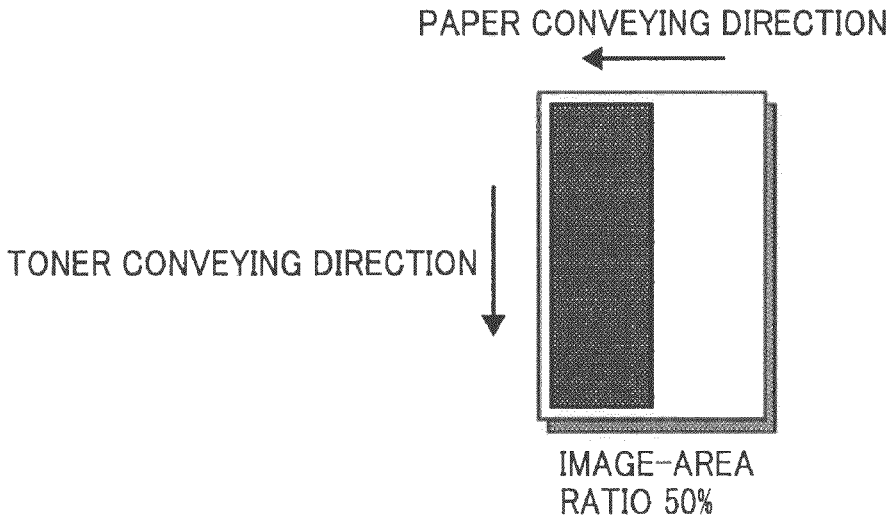
FIG. 21 is a schematic diagram of an A4-sized paper sheet on which a flat-black image is printed only on the upstream half thereof in a direction the paper is conveyed.

The reference consumption waveform corresponds to a flat-black image output onto a sheet of an A4-sized paper, such as one shown in FIG. 18 (the image-area ratio=100%). If the image-area ratio is less than 100%, it is considered that a page full of half-tone image, such as one shown in FIG. 19, is output, regardless how pixels are distributed within the paper sheet. More specifically, the image-area ratio of a page full of half-tone image, shown in FIG. 19, is 50%. Examples of an image whose image-area ratio is 50% include not only a page full of half-tone image as shown in FIG. 19, but also an image of characters, a partial flat-black image locally laid on a partial area along the toner conveying direction, as shown in FIG. 20, or a partial flat-black image locally laid on a partial area along the paper conveying direction, as shown in FIG. 21. Such character image and partial flat-black image are all considered as a page full of half-tone image shown in FIG. 18.

Figure 22:
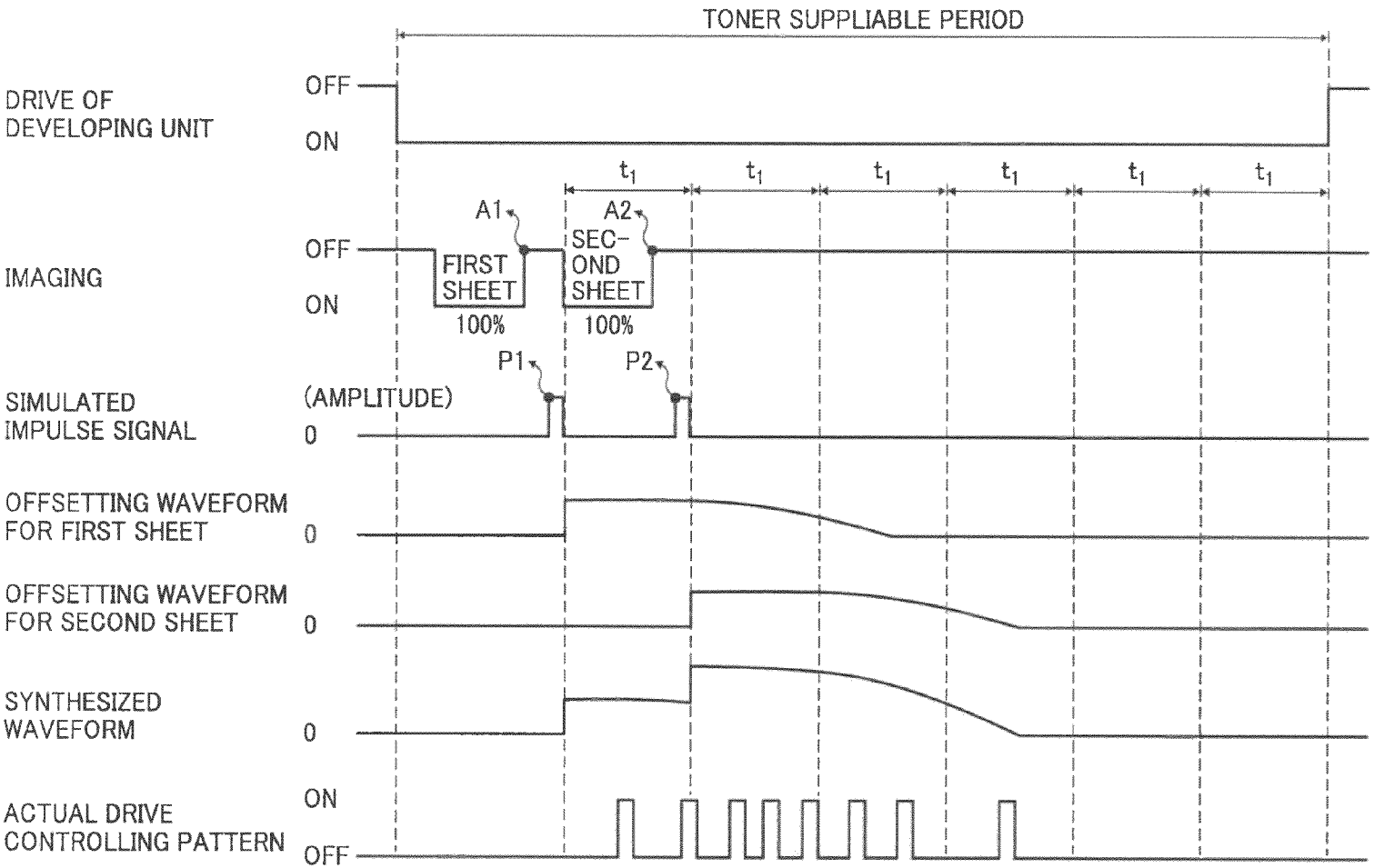
FIG. 22 is a timing chart for explaining the toner supply control executed while an image forming operation is continuously being performed.

FIG. 22 is a timing chart for explaining a toner supply control preformed when an image forming operation is continuously executed. When an image forming operation is continuously executed, the supply controlling unit 102 outputs a simulated impulse signal having an amplitude corresponding to the image-area ratio, causes the ANC filter circuit to output the offsetting waveform that can offset the toner concentration variation predicted to occur in the developer in the first developer container 9Y, to create a drive controlling pattern corresponding thereto. Then, as shown in FIG. 22, the supply controlling unit 102 synthesizes a drive controlling pattern created based on the next page onto the unexecuted portion of the drive controlling pattern created based on the image-area ratio of the previous page. The portion that has already been reflected for the actual drive control is excluded.

As shown in FIG. 22, when a page worth of images is output, the toner variation, occurred due to the toner consumption for the image output, persists for a relatively long time in the first developer container. Therefore, the drive controlling pattern corresponding to a page needs to control the toner supplying unit for a relatively long time. In this situation, when driving of the toner supplying unit is controlled to offset the toner concentration variation caused by an output of the previous page, such a control must be able to last for the time of the following page output. Therefore, a drive controlling pattern is sequentially created for each page, and the drive controlling pattern of the next page is synthesized with the unexecuted portion of the drive controlling pattern of the previous page. Then, the driving of the toner supplying unit is controlled according to the synthesized drive controlling pattern. By way of such a control, the toner is supplied in an amount corresponding to a toner concentration variation occurring due to a page output and persisting for a relatively long time. In this manner, the toner can be supplied in an appropriate amount for the toner concentration of the developer, through the toner supplying opening.

A drive controlling pattern is made of a plurality of rectangular-shaped pulse signals arranged one after another. If a plurality of drive controlling patterns is simply superimposed over one another, the amplitude of the rectangular-shaped pulse signal becomes increased. However, in the printer according to the embodiment, the amount of the toner supply is not adjusted by controlling the driven speed, and the driven speed is kept constant. Thus, the control cannot be performed to reflect the increase in the amplitude of a rectangular-shaped pulse signal. In response to this problem, if rectangular-shaped pulse signals are to become superimposed over one another upon synthesizing the drive controlling pattern of the next page to that of the previous page, the positions of the rectangular pulse signals in one of the drive controlling patterns are shifted with respect to those in the other so as to avoid such superimposition.

Instead of synthesizing the drive controlling pattern of the next page to the unexecuted portion of the drive controlling pattern of the previous page to control driving of the toner supplying unit, the ANC filter circuit may be structured as follows. If a simulated impulse signal corresponding to the next page is received, the ANC filter corrects an unexecuted portion of the offsetting waveform, created based on a simulated impulse signal corresponding to the previous page, by synthesizing the offsetting waveform created based on the next simulated impulse signal thereto. In other words, the ANC filter may be structured to output the synthesized waveform shown in FIG. 22.

Figure 23:
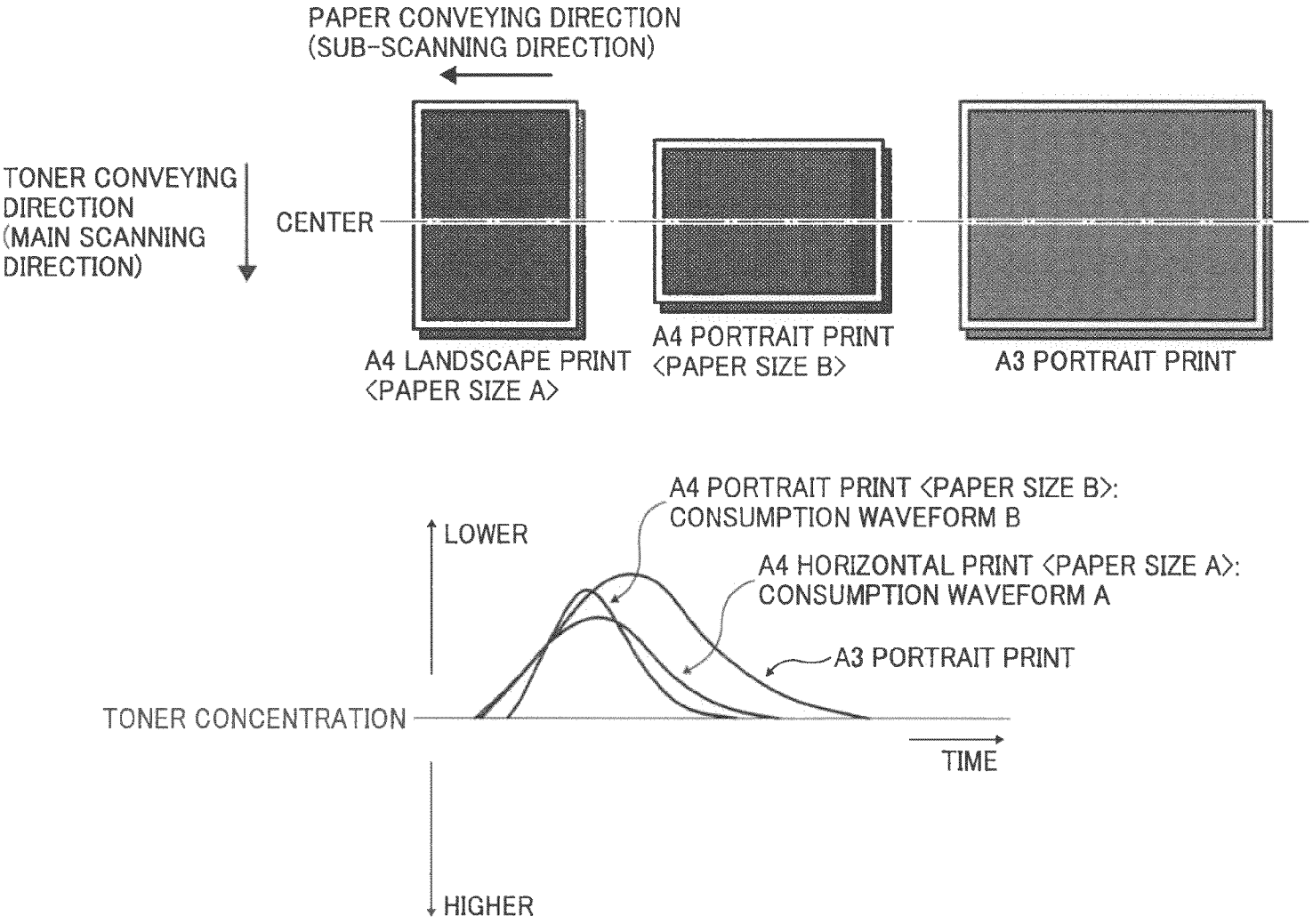
FIG. 23 is a schematic diagram of a relationship between the size and the conveyed direction of a recording paper, and the waveform of toner concentration variation that occurs upon outputting a flat-black image.
Figure 24:
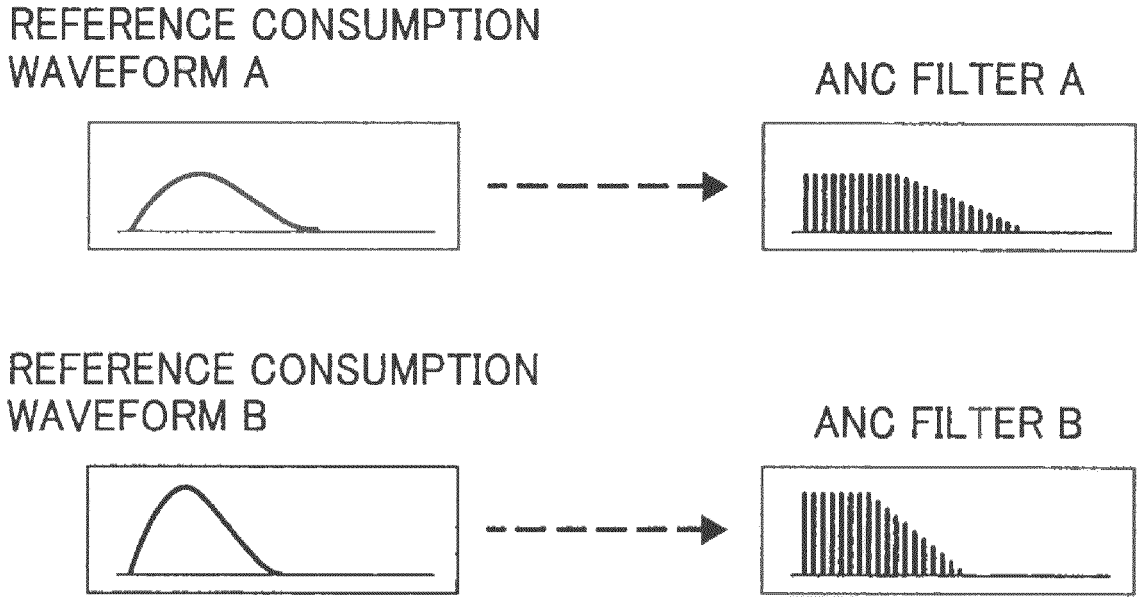
FIG. 24 is a schematic diagram of a relationship between reference consumption waveforms different from each other and ANC filter circuits.

In the explanation above, it is assumed that the size or the conveyed direction of the recording paper to be used remains constant; however, in reality, the size or the conveyed direction of the recording paper changes. For example, an A4-sized recording paper is sometimes conveyed laterally along the short-length direction, and some other time, an A4-sized recording paper is vertically conveyed along the longitudinal direction. A recording paper of a completely different size may also be conveyed laterally. FIG. 23 is a schematic diagram of a relationship between the size and the conveyed direction of a recording paper, and the waveform of the toner concentration variation that occurs in outputting a flat-black image (image-area ratio=100%). As shown in FIG. 23, when a flat-black image having an image-area ratio of 100% is output onto sheets of recording papers each having a different size and conveyed in a different direction, the waveform of the toner concentration variation changes accordingly. This suggests that the reference consumption waveform will also change depending on the size and the conveyed direction of a recording paper sheet. Therefore, as shown in FIG. 24, different ANC filter circuits need to be used depending on the size and the conveyed direction of a recording paper.

Figure 25:
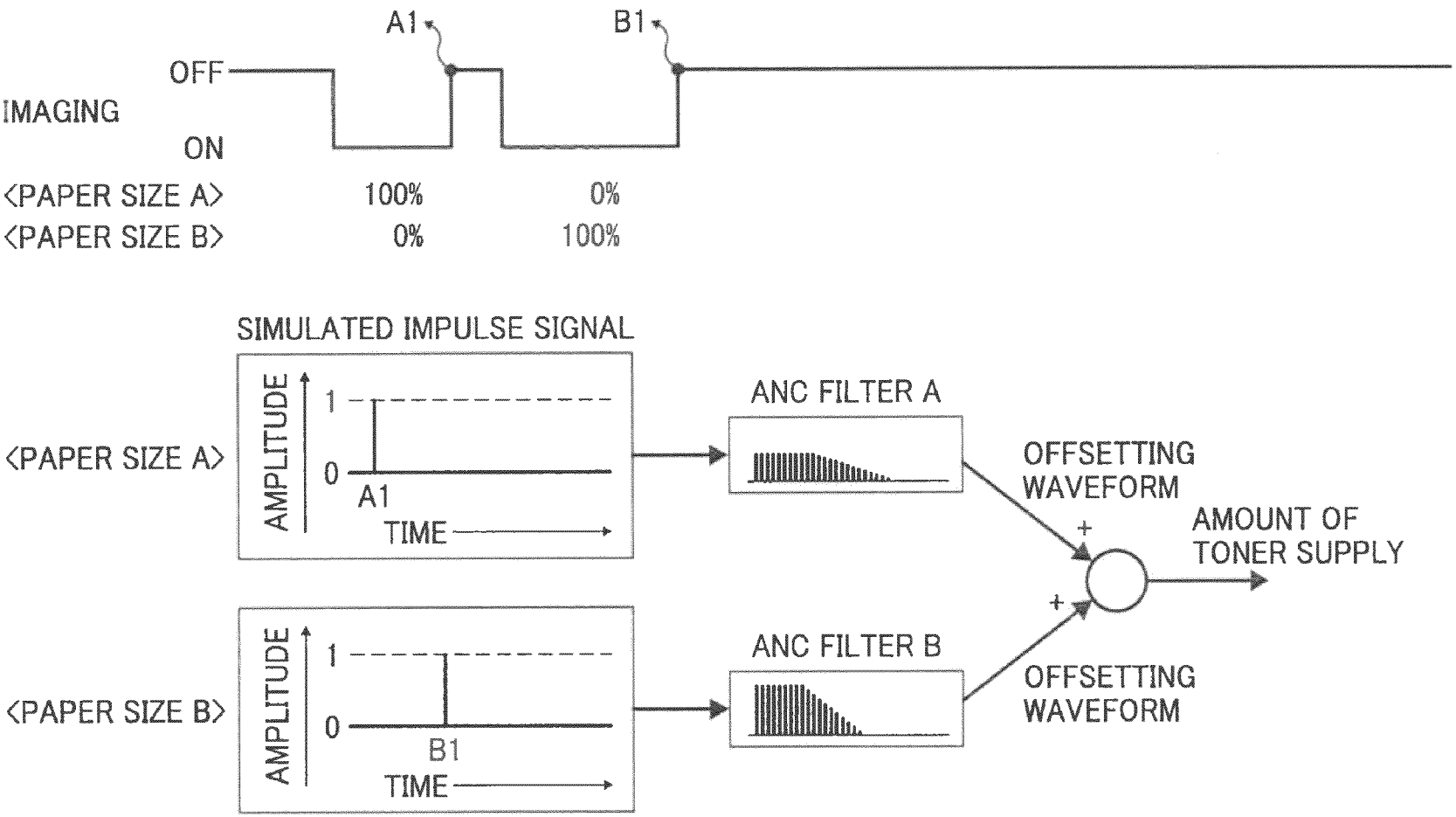
FIG. 25 is a circuit diagram for explaining how a simulated impulse signal is input to the ANC filter when recording paper sheets of different sizes are used for the first page and the second page.
Figure 26:
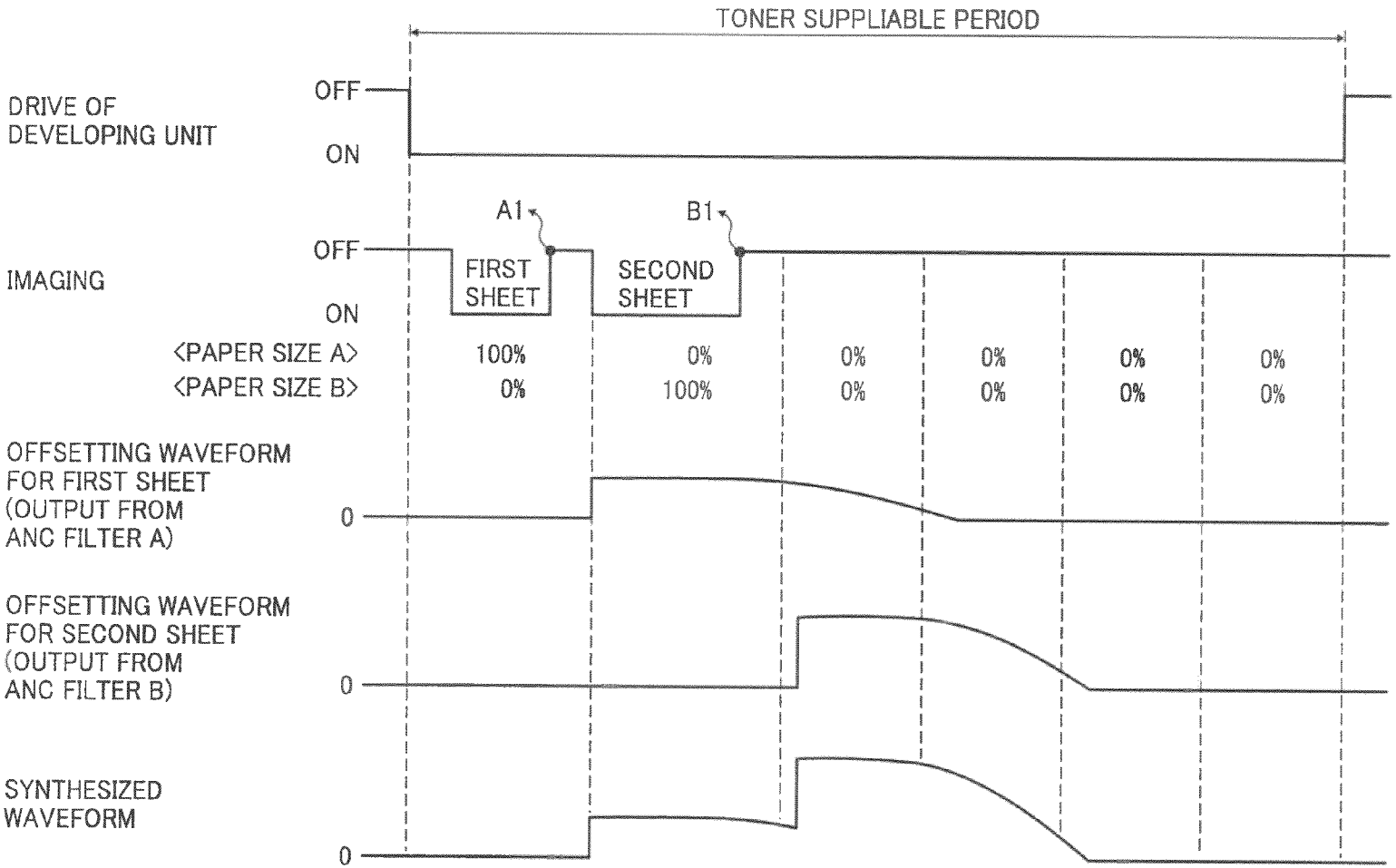
FIG. 26 is a timing chart for explaining how the toner supply control is performed when recording paper sheets of different sizes are used for the first page and the second page.

Thus, the printer according to the embodiment includes a plurality of ANC filter circuits each corresponding to each of a plurality of standard sizes of recording papers and the conveyed directions thereof. While a page is being output, a simulated impulse signal, corresponding to the image area of the output page, is output to the ANC filter circuit corresponding to the size and the conveyed direction of the output page. For example, it is assumed herein that a size A is output on the first page, and a size B is output on the second page. As shown in FIGS. 25 and 26, upon outputting the size A on the first page, the simulated impulse signal is output only to an ANC filter A; and upon outputting the size B on the second page, the simulated impulse signal is output only to an ANC filter B. The output end of each of these ANC filters is connected in parallel. In other words, by selecting an algorithm (an ANC filter) corresponding to the size and the conveyed direction of the paper sheet, a drive controlling pattern is created for each of the pages.

Figure 27:
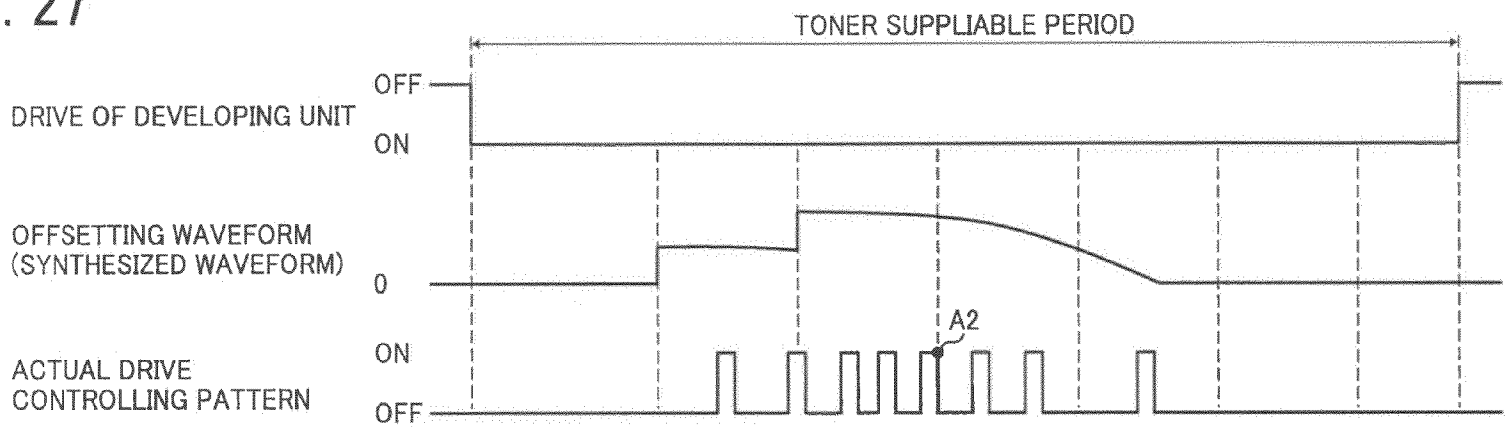
FIG. 27 is a timing chart for explaining the toner supply control performed in the latter half of a print job.
Figure 28:
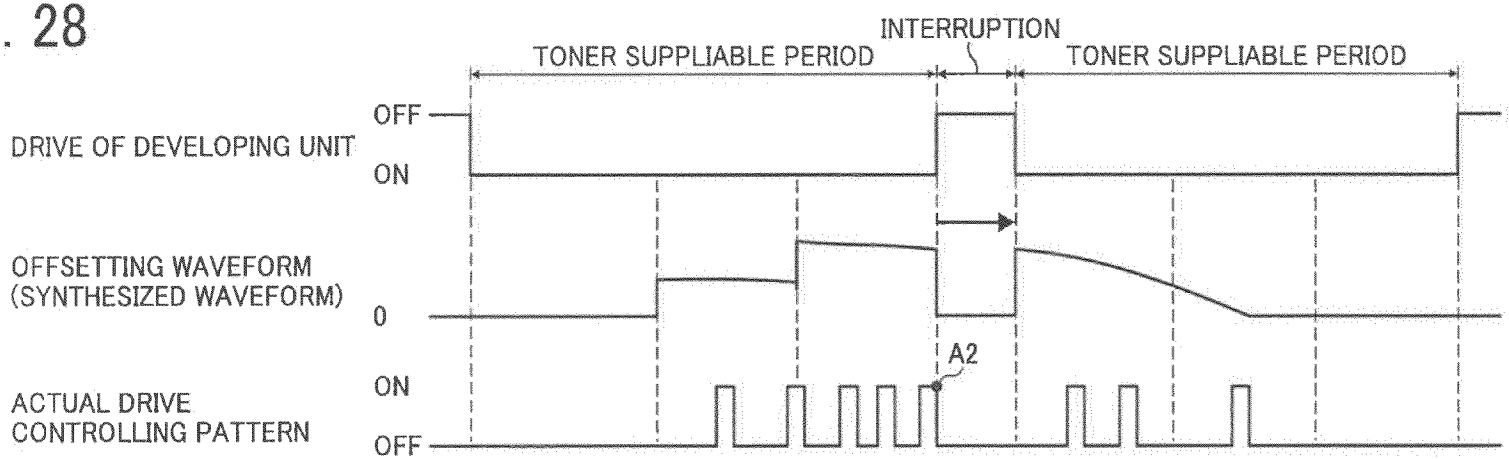
FIG. 28 is a timing chart for explaining a relationship between the toner supply control performed upon ending a prior print job, and the toner supply control performed upon initiating a current print job.

Upon completing the output of the last page when an image forming operation is continuously executed, or upon completing the output of a single page when an image forming operation is executed for a single page, an idle operation is run for a predetermined length of time, and each of the units is stopped driving. At this time, no problem will occur if an entire drive controlling pattern for the toner supplying unit is completely executed; however, when the toner concentration variation, due to toner consumption for the previous page, persists for a quite large number of pages, the entire drive controlling pattern may not be completely executed. In this situation, if the idle operation is kept running until the entire drive controlling pattern is executed completely, the idle operation might prevent a print job to be ended quickly. In addition, generally upon starting a print job, an idle operation is also run for a predetermined length of time before starting an image formation. Thus, even if the supply controlling unit 102 stops driving each of the units before completely executing a portion of a drive controlling pattern when a print job is ended, that portion can be executed during the idle operation performed upon starting a print job. Therefore, in the printer according to the embodiment, the supply controlling unit 102 is structured to store an incomplete portion of the drive controlling pattern, if any, in a data storage unit upon ending a print job, and to perform a control to drive the toner supplying unit based on that portion of the pattern upon starting the next print job. For example, it is assumed herein that, if the entire scheduled drive controlling pattern is to be executed upon ending a print job, the control will be performed in the manner as shown in the timing chart in FIG. 27. In this timing chart, the print job should be completed at the timing of a point A2; however, at this point in time, the entire drive controlling pattern is not executed yet. In such a situation, a portion of the drive controlling pattern subsequent to the point A2 is stored in the data storage unit at the time the print job is ended at the point A2 shown in FIG. 28. Then, upon starting the next print job, the portion of the drive controlling pattern is executed.

If the ANC filter circuit is structured to correct the output waveform so as to output the synthesized waveform shown in FIG. 22 when the output of the next page occurs, instead of the drive controlling pattern being corrected, the unexecuted portion of the waveform at the point A2 is stored in the ANC filter circuit. More specifically, upon ending a print job, a job end signal is input to the ANC filter circuit. When the job end signal is input, the drive controlling pattern is temporality stopped being output and the unexecuted portion of the waveform is stored in the ANC filter circuit. When a next print job command is issued to start a print job, a job start signal is input to the ANC filter circuit. Such an input causes the ANC filter circuit to output the unexecuted portion of the waveform that has been stored therein up to the point in time.

Figure 29:
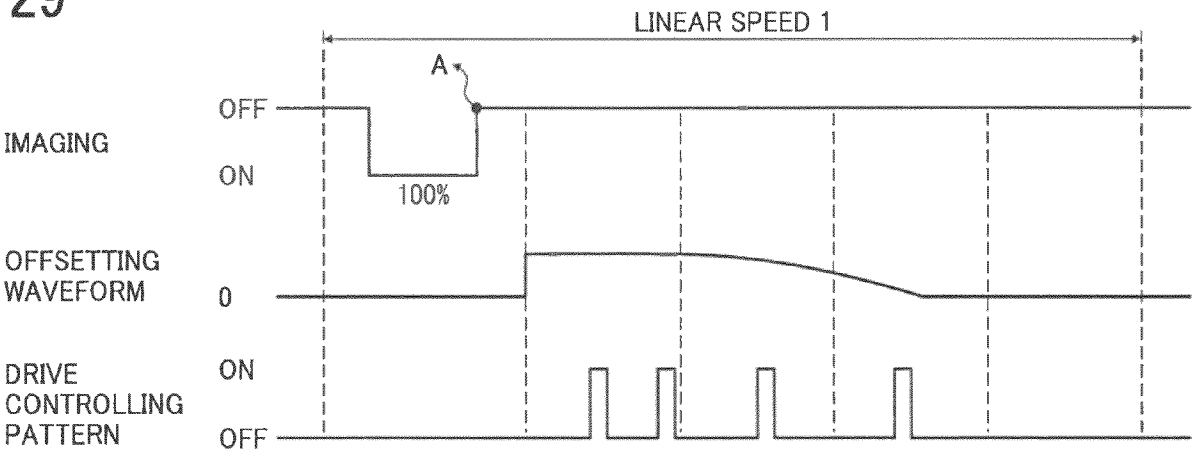
FIG. 29 is a timing chart for explaining how a toner supply control is performed when a print job is executed at a single linear speed from the beginning to the end.
Figure 30:
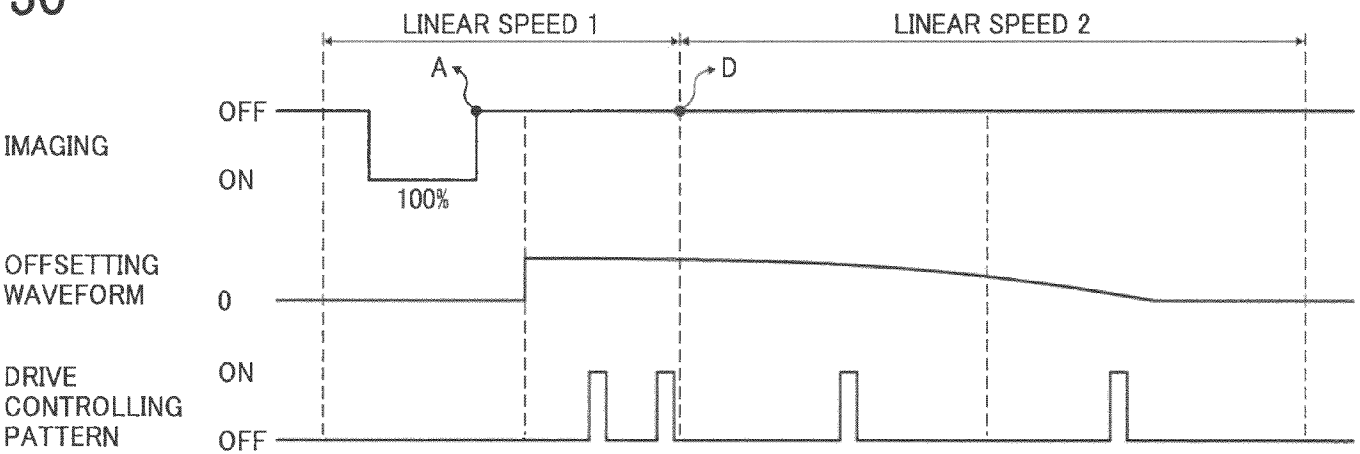
FIG. 30 is a timing chart for explaining how a toner supply control is performed when the linear speed is switched from one to another while a print job is being executed.

The printer according to the embodiment is switched between two printing speed modes (a high-speed print mode and a low-speed print mode) according to an instruction issued by a user. If the printing speed, that is, a linear processing speed is changed, the rotation speed of the conveying screw in the developing unit also changes, thus resulting in a different reference consumption waveform or offsetting waveform. The drive controlling pattern will also be different. However, a drive controlling pattern at one linear processing speed can be converted into a drive controlling pattern at the other linear processing speed based on the difference in the linear speed. For example, it is assumed herein the drive controlling pattern at the low-speed printing mode is as shown in FIG. 29. If the printing mode is switched to the high-speed printing mode immediately after the drive controlling pattern is created and before the drive controlling pattern is executed, the created drive controlling pattern needs to be corrected to that of the high-speed printing mode before its execution. Assuming that the linear processing speed of the high-speed printing mode is 1.5 times faster than that of the low-speed printing mode, the drive controlling pattern can be corrected to the pattern for the high-speed printing mode by making the positioning of each of the rectangular pulse signals in the low-speed printing mode 1.5 times, the same multiple as that of the linear speed, on the time axis, as shown in FIG. 30. Thus, the supply controlling unit 102 is structured to correct each of the rectangular pulse signals included in an unexecuted portion of the drive controlling pattern in proportion to the linear speed, when the printing speed is switched. In other words, when the driven speed of the developing unit is changed in response to a change in the printing speed mode, the supply controlling unit 102 corrects the drive controlling pattern with respect to the difference between the driven speeds before and after the change.

When the ANC filter circuit is structured to correct the waveform output therefrom so as to output the synthesized waveform shown in FIG. 22, instead of correcting the drive controlling pattern upon occurrence of the next page output, the following device can be provided. That is, the waveform output from the ANC filter can be corrected in proportion to the difference in the driven linear speeds.

Figure 31:
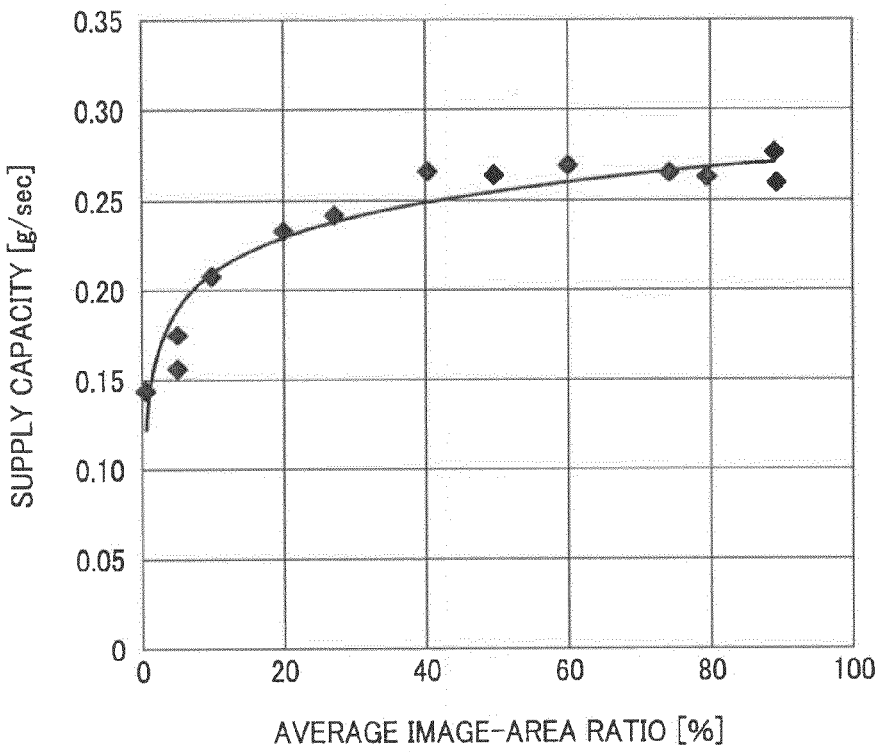
FIG. 31 is a graph of a relationship between a toner supply capability of the toner supplying unit during the continuous image forming operation and an average image-area ratio.

If an average of the image-area ratio in the output image changes while an image forming operation is continuously executed, the toner supply capability of the toner supplying unit will also change. FIG. 31 is a graph of a relationship between the toner supply capability of the toner supplying unit and an average image-area ratio while an image forming operation is continuously performed. As shown in FIG. 31, the higher the average image-area ratio is during the continuous image forming operations, the higher the toner supply capability becomes. Such a difference in the toner supply capability occurs due to reasons described below. In other words, the higher the average image-area ratio is, the more toner is consumed. Therefore, the larger amount of toner needs to be supplied to maintain the toner concentration in the developer, provided in the developing unit, at a constant level. The larger amount of toner is supplied, the more often the toner supplying unit is driven. In this manner, the intervals between the driven operations become shorter. In response, a large amount of toner is supplied into the hopper 76Y shown earlier in FIG. 10 within a shorter time period, and the flowability of the toner in the hopper 76Y increases. By way of this increase in toner flowability, the amount of toner supplied in a driven time unit increases. On the contrary, if the average image-area ratio is low, the flowability of the toner in the hopper 76Y decreases, further reducing the amount of toner supplied in a driven time unit. As described above, it becomes difficult to stabilize the toner concentration, if the toner supply capability changes depending on the average image-area ratio.

In response to this problem, during the continuous image forming operations, the printer according to the embodiment obtains a moving average of the image-area ratio of the output image, and, based on the result, corrects the amount of toner supplied per unit image-area ratio.

Figure 32:
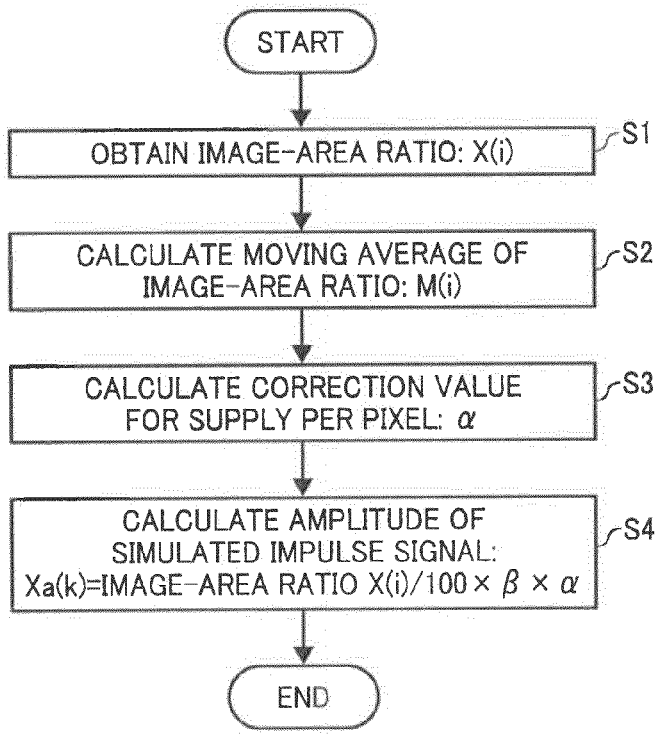
FIG. 32 is a flowchart of a process performed by the supply controlling unit for correcting the amount of supplied toner.

FIG. 32 is a flowchart of a process of correcting the amount of supplied toner performed by the supply controlling unit 102. To begin with, the supply controlling unit 102 obtains the image-area ratio (%): X(i) of an output image on a target page (Step 1 (S1): hereinafter, Step is abbreviated as "S"). The supply controlling unit 102 then calculates a moving average based on the image-area ratios in the several pages prior the target page and the image-area ratio X(i) of the target page (S2). For example, a moving average is obtained based on a formula: "Moving Average $M(i)=(M(i-1)\times(N-1)+X(i))/N$". In this formula, M(i) denotes to a current value of the moving average of the image-area ratio; M(i−1) denotes to the previous moving average of the image-area ratio; N is a cumulative number of paper sheets; and X(i) is a current image-area ratio (%). M(i) and X(i) are calculated for each of the colors. The moving average is used to factor in a history of the image-area ratio of output images. For example, if a moving average of image-area ratio is higher, it means that images of high image-area ratio are continuously being output. In this scenario, the toner supply capability increases.

A data table is stored in the data storage unit beforehand for determining a correction coefficient. Then, with reference to the data table, a correction coefficient α corresponding to the moving average of the image-area ratio is determined (S3). An example of the data table is shown in Table 1.

TABLE 1

| Cumulative Average of Image-Area Ratio [% or below] | Correction Coefficient α |
|---|---|
| 5 | 1.20 |
| 10 | 1.10 |
| 15 | 1.00 |
| 20 | 1.00 |
| 30 | 0.95 |
| 40 | 0.90 |
| 50 | 0.86 |
| 60 | 0.85 |
| 70 | 0.85 |
| 80 | 0.85 |
| 90 | 0.80 |
| 100 | 0.80 |

The higher the moving average of the image-area ratios is, the smaller correction coefficient α is selected, based on the fact that the higher the moving average is, the higher the toner supply capability of the toner supplying unit becomes. Alternatively, this data table may be those shown in Table 2 or 3, as long as the smaller correction coefficient α is selected when the moving average becomes higher.

TABLE 2

| Cumulative Average of Image-Area Ratio [% or below] | Correction Coefficient α |
|---|---|
| 5 | 1.00 |
| 10 | 1.00 |
| 15 | 1.00 |
| 20 | 1.00 |
| 30 | 1.00 |
| 40 | 1.00 |
| 50 | 1.00 |
| 60 | 1.00 |
| 70 | 1.00 |
| 80 | 1.00 |
| 90 | 0.90 |
| 100 | 0.80 |

TABLE 3

| Cumulative Average of Image-Area Ratio [% or below] | Correction Coefficient α |
|---|---|
| 5 | 1.20 |
| 10 | 1.10 |
| 15 | 1.00 |
| 20 | 1.00 |
| 30 | 1.00 |
| 40 | 1.00 |
| 50 | 1.00 |
| 60 | 1.00 |
| 70 | 1.00 |
| 80 | 1.00 |
| 90 | 1.00 |
| 100 | 1.00 |

An amplitude (height) Xa(k) of the simulated impulse signal is then calculated (S4). At this time, a formula "Amplitude Xa(k)=image-area ratio X(i)/100×β×α" is used. In this formula, β denotes to an amplitude with the image-area ratio X(i) of 100(%). α denotes to the correction coefficient. If the characteristic shown in FIG. 31 is different for each of the colors K, C, M, and Y, the correction coefficient α is calculated for each of the colors. In this situation, a formula "Amplitude Xa(k)=image-area ratio X(i)/100×β×α color correction coefficient" should be used.

As an example with specific numbers, when images of the image-area ratio 80 (%) are continuously output, the moving average of the image-area ratio will be 80(%). Based on the data table shown in Table 1, the correction coefficient α is determined to be 0.85. Assuming that the amplitude β with the image-area ratio X(i) of 100(%) is 1, the amplitude Xa of the simulated impulse signal will be 0.68, based on the calculation "Amplitude of Simulated Impulse signal Xa(k)=0.8×1×0.85". By adopting the amplitude Xa, the amount of toner supplied per an image-area ratio unit is corrected. In this manner, the amount of supplied toner can be prevented from becoming inappropriate, due to the change in toner supply capability caused by a change in the average image-area ratio.

The supply controlling unit 102 also performs a toner supply control based on a difference between an output voltage (Vt) from the toner concentration sensor and a target voltage Vtref that is a control target of the toner concentration, in parallel with the toner supply control performed in the above-described manner based on the image-area ratio. More specifically, the supply controlling unit 102 samples the output voltage Vt from the toner concentration sensor (for example, 10Y) at a predetermined sampling cycle, and obtains an average of Vt over a predetermined time period, every time the predetermined time elapses. If the average of the Vt is higher than the target voltage Vtref, that is, if the toner concentration in the developer in the first developer container is lower than a target value, the drive controlling pattern, created based on the image-area ratio, is corrected according to the amount of supplied toner required to resolve the difference between the Vt average and the target voltage Vtref. In this manner, by recognizing an excess or a shortage of supplied toner based on the detected result of the toner concentration, the supply controlling unit 102 corrects the length of time the toner supply unit is driven, determined based on the image information, based on the excess or shortage in the amount of the supplied toner. By way of this correction, the supply controlling unit 102 eliminates an error between a theoretical amount of supplied toner based on the image-area ratio, and the amount of toner actually needed to be supplied. In this manner, it is possible to avoid a development performance degradation that might have occurred if such an erroneous toner supply were to be continued.

Other embodiments in which the printer according to the embodiment is provided with additional characterizing structures will be now explained. Otherwise specified herein, the structure of the printer according to these embodiments will be the same as the one according to the embodiment described above.

First Embodiment

The supply controlling unit 102 in the printer according to a first embodiment of the present invention obtains a Vt average that is an average of the detection results detected by a toner concentration sensor, for each of the colors K, C, M, and Y. The supply controlling unit 102 then obtains an additional drive controlling pattern required for bringing the Vt average to a predetermined target, that is, for bringing the Vt average to the target voltage Vtref, for the toner supplying unit. The drive controlling pattern, created based on the image-area ratio, is corrected by synthesizing this additional drive controlling pattern thereto.

Figure 33:
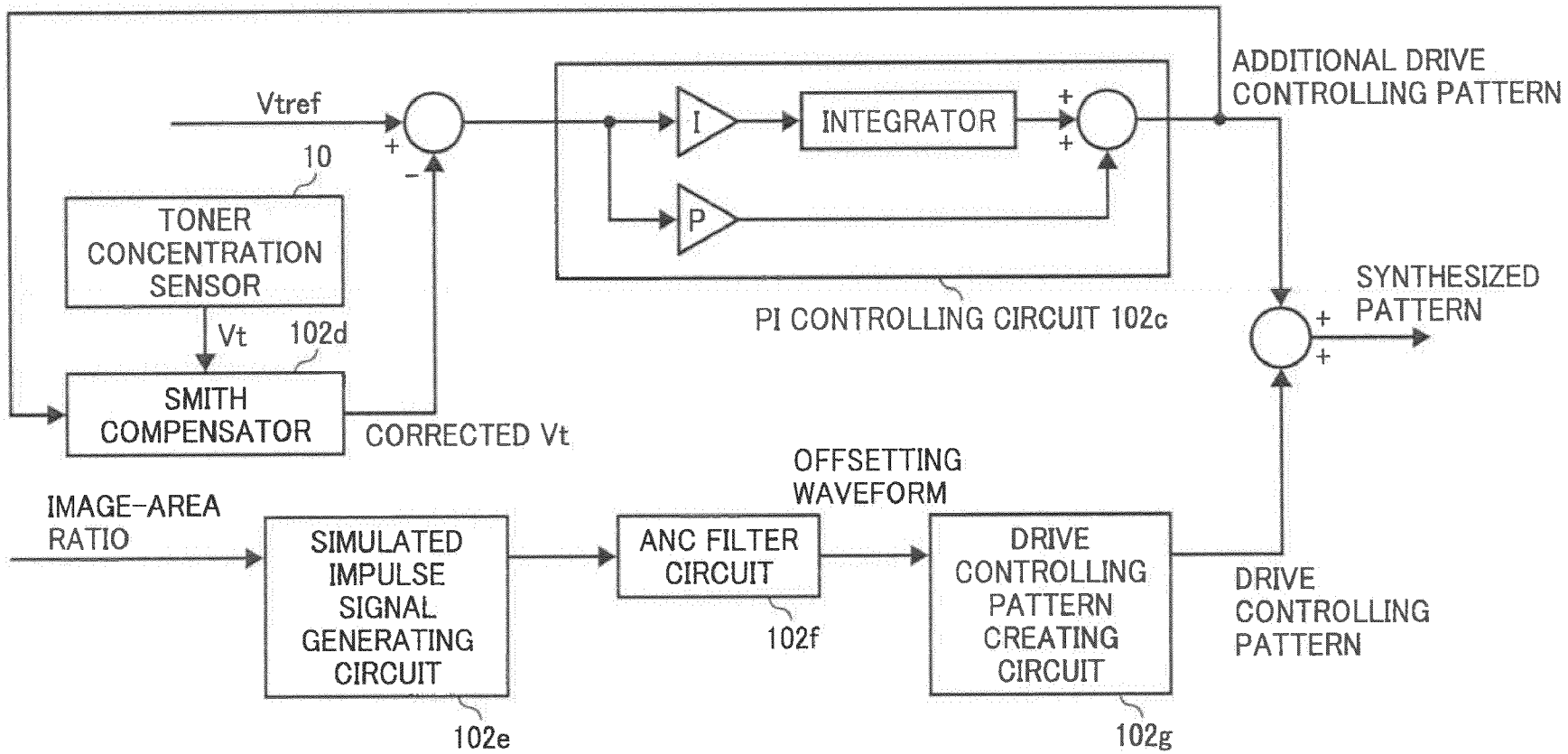
FIG. 33 is a block diagram of an exemplary internal structure of a supply controlling unit provided in a printer according to a first embodiment of the present invention.

FIG. 33 is a block diagram of an exemplary internal structure of the supply controlling unit 102 in the printer according to the first embodiment. The supply controlling unit 102 includes a CPU, a RAM, and a ROM, in addition to structures shown in FIG. 33. The supply controlling unit 102 inputs a simulated impulse signal, generated by a simulated impulse signal generating circuit 102*e* and having an amplitude corresponding to an image-area ratio of an output image, to an ANC filter circuit 102*f*. The offsetting waveform, output from the ANC filter circuit 102*f*, is input to a drive controlling pattern creating circuit 102*g*. The drive controlling pattern creating circuit 102*g* creates a drive controlling pattern having a pattern that is similar to an analog offsetting waveform (a pattern of ON and OFF of a rectangular pulse signal). The processes up to this point are the same as those described above in the embodiment. In this manner, while creating a drive controlling pattern corresponding to the image-area ratio of an output image, the supply controlling unit 102 also creates additional drive controlling patterns corresponding to a difference between the Vt average and the target voltage Vtref based on the difference between the Vt average of the toner concentration detection results of the toner concentration sensor 10 and the target voltage Vtref that is the target value of the toner concentration. More specifically, Vt that is the output value from the toner concentration sensor 10 is input to a Smith compensator 102*d*. The Smith compensator 102*d* corrects Vt, and at the same time, calculates an average of the corrected Vt. A correction method performed thereby will be explained later. The average of the corrected Vt output from the Smith compensator 102*d* is used for calculating the difference between the average and the target voltage Vtref. The difference is input to a PI controlling circuit 102*c*. As well known in the art, the PI controlling circuit 102*c* creates a feedback signal by way of a combination of a P amplifier circuit (P is an abbreviation of "proportional") and an I amplifier circuit (I is an abbreviation of "integral"). The P amplifier circuit changes an input value in proportion to a difference between a target value and an actual measurement, and the I amplifier circuit changes an input value in proportion to an integration of the difference. The drive controlling pattern, created beforehand based on an image-area ratio, is corrected by synthesizing an additional drive controlling pattern that is the feedback signal output from the PI controlling circuit

102*c* thereto. Then, this corrected drive controlling pattern is used for controlling the amount of supplied toner.

In FIG. 5 mentioned earlier, the toner supplying opening 17Y is located upstream of the toner concentration sensor 10Y along the direction in which the toner is conveyed. Let us assume that the toner is supplied at the position of the toner supplying opening 17Y, according to the drive controlling pattern not synthesized with the additional drive controlling pattern. In this situation, if the theoretical amount of toner consumption is less than the actual amount of toner consumed in an actual image output, the toner concentration will be less than the target value in the developer, even after the toner is added. Thus, the output voltage Vt from the toner concentration sensor 10Y will be higher than the target voltage Vtref (the sensor output will indicate a behavior opposite to an increase or a decrease of the toner concentration). To compensate for the shortage in the amount of supplied toner, the additional drive controlling pattern is created as described above, and synthesized to the drive controlling pattern remaining unexecuted at that point in time. From the point in time and thereafter, the toner is supplied in an amount determined necessary based on the image-area ratio, plus the amount that is determined to be short based on the difference between the Vt average and the target voltage Vtref. The toner concentration sensor 10Y then detects the variation in the toner concentration, resulting from such a combinatory toner supply. However, the toner concentration sensor 10Y detects the toner concentration variation due to the latter toner supply, only after a time lag corresponding to the time required for the supplied toner to move from under the toner supplying opening 17Y to under the toner concentration sensor 10Y. If such a time lag occurs, the detection timing of the recovery in the toner concentration, recovered by way of the latter toner supply, will become delayed. The toner then will be supplied excessively due to the delay, causing the waveform of the toner concentration variation to surge greatly. Thus, in the printer according to the first embodiment, the Vt value output from the toner concentration sensor 10Y is corrected using the Smith compensator 102*d*, to prevent such a time lag from occurring.

Figure 34:
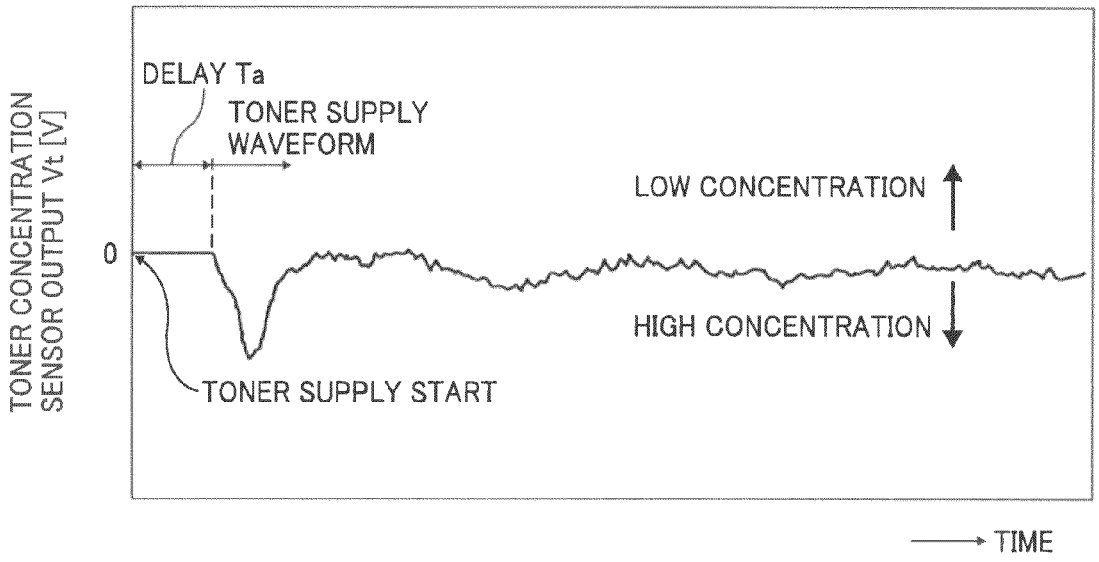
FIG. 34 is a graph of variations in outputs of a toner concentration sensor over time, when a toner supply operation is performed one time for a length of time corresponding to the lower limit B.
Figure 35:
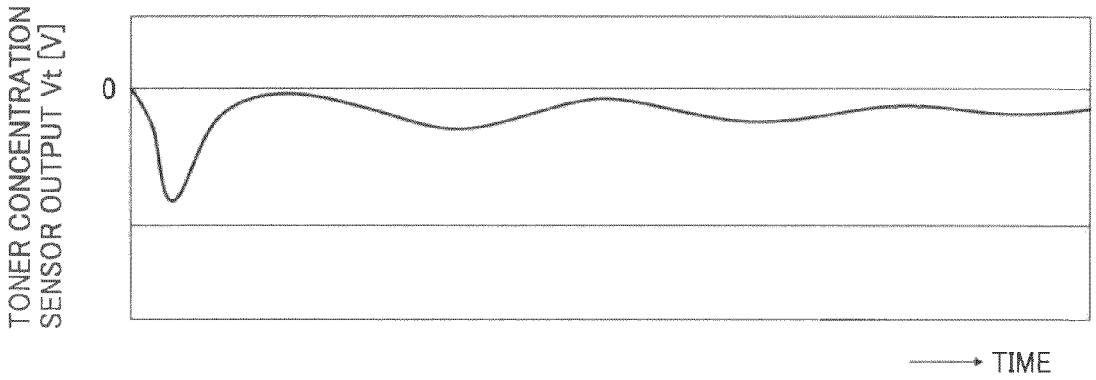
FIG. 35 is a graph of a theoretical waveform created based on the variation shown in FIG. 34.

The Smith compensator 102*d* will now be explained in further detail. FIG. 34 is a graph of variation of the output from the toner concentration sensor over time, when a toner supply operation is performed once in a driven time that corresponds to the lower limit B. As shown in FIG. 34, the output voltage Vt [V] from the toner concentration sensor does not change when the toner supply operation is initiated. After a predetermined delay Ta, the output voltage Vt starts to decrease. This is because the delay Ta is required for the toner supplied at the position of the toner supplying opening (17Y) to move to the position detected by the toner concentration sensor (10Y). A preparatory experiment is run to check how the variation occurs over time as shown in FIG. 34, and a portion of the waveform of the variation, corresponding to the variation after the delay Ta, is stored as a theoretical waveform as shown in FIG. 35. Every time the toner supplying unit is driven for the lower limit B with the additional drive controlling pattern, the Smith compensator 102*d* assumes that the theoretical waveform shown in FIG. 35 will occur, and corrects the output voltage Vt. Actually, the theoretical waveform, shown in FIG. 35, will occur after the delay Ta elapses since the time the toner supplying unit is driven for the lower limit B; however, the output voltage Vt is corrected, assuming that the theoretical waveform, shown in FIG. 35, occurs at the time the toner supplying unit is driven for the lower limit B. In other words, when the toner supplying unit is driven for the lower limit B, the theoretical waveform, shown in FIG. 35, is added to the output voltage Vt. After the delay Ta elapses, the concentration sensor will actually start detecting the variation like the theoretical waveform shown in FIG. 35. Thus, the difference needs to be corrected. In response to this issue, after the delay Ta elapses, the output voltage Vt is corrected by adding a waveform having a phase opposite to that of the theoretical waveform shown in FIG. 35. By performing such a correction, it is possible to recognize the output voltage Vt with the toner supply operation kept being performed without the additional drive controlling pattern.

When, instead of correcting the drive controlling pattern upon occurrence of the next page output, the ANC filter circuit is structured to correct the waveform output therefrom so as to output the synthesized waveform, as shown in FIG. 22, the following device can be provided. That is, instead of creating the additional drive controlling pattern based on the output voltage Vt and the output target Vtref, a virtual pattern of the toner concentration variation of the developer is obtained. Such a virtual pattern indicates how the toner concentration changes upon bringing the toner concentration from the current value of the output voltage Vt, reflecting the toner concentration in the developer, to the output target Vtref. The virtual pattern of the toner concentration variation is then synthesized to (superimposed onto) the waveform that is output from the ANC filter circuit, and is the pattern of the toner supply variation created based on the image-area ratio.

Second Embodiment

Figure 36:
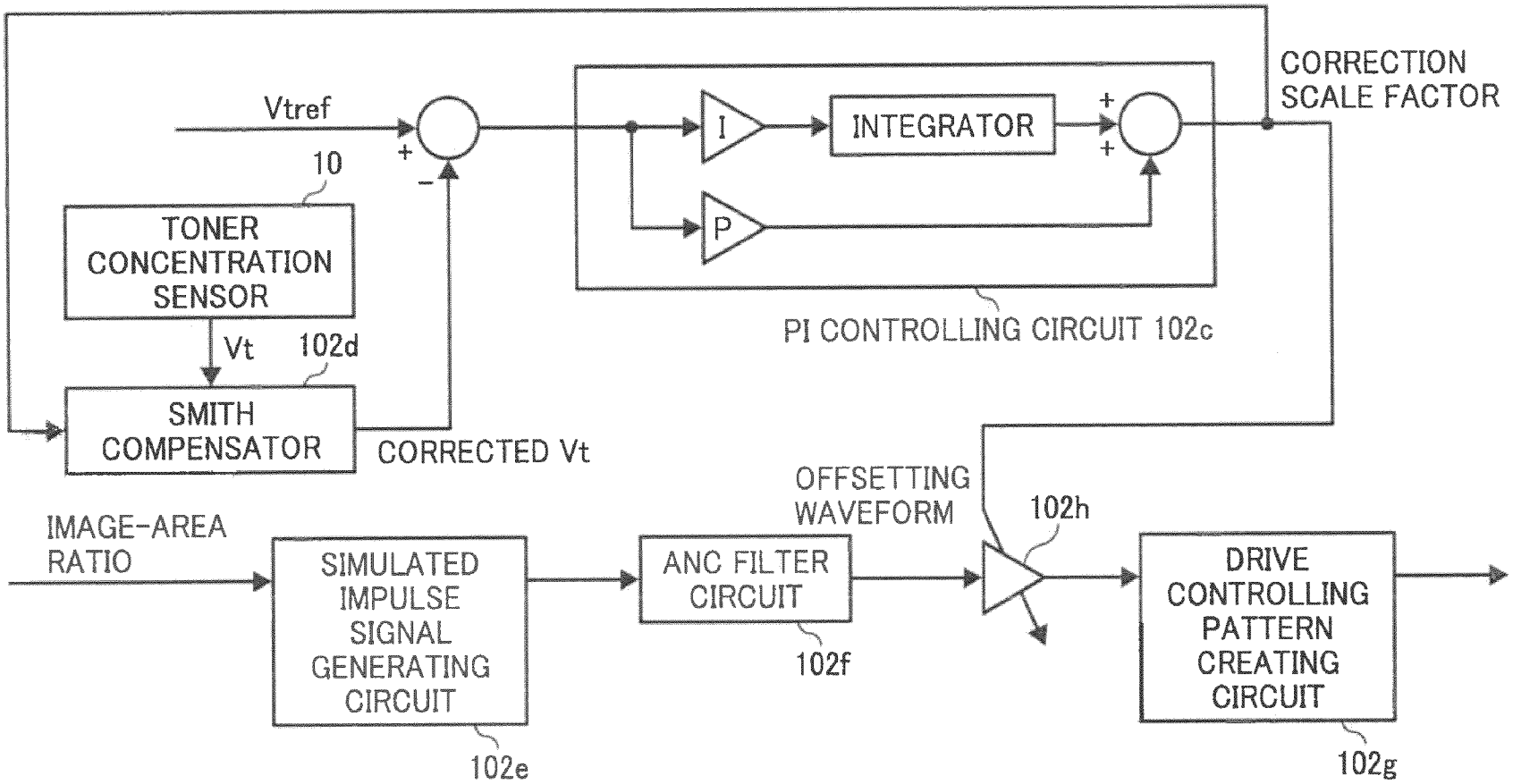
FIG. 36 is a block diagram of an exemplary internal structure of the supply controlling unit included in a printer according to a second embodiment of the present invention.

The supply controlling unit 102 in the printer according to a second embodiment of the present invention obtains a Vt average that is an average of the detection results of a toner concentration sensor, for each of the colors K, C, M, and Y. The supply controlling unit 102 then obtains a correction scale factor for the amount of the toner required to be supplied per image-area ratio to bring the Vt average to a predetermined target, that is, to bring the Vt average to the target voltage Vtref. To describe more in detail, the supply controlling unit 102 obtains how many times the amplitude of the offsetting waveform should be multiplied to bring the Vt average to the target voltage Vtref, and uses the result as a correction scale factor. The drive controlling pattern, created based on the image-area ratio, is corrected based on the correction scale factor. More specifically, the drive controlling pattern is corrected so that each of the rectangular pulse signals to be included in the drive controlling pattern is generated in a frequency multiplied by the correction scale factor with respect to the frequency in the original drive controlling pattern. Preferably, the offsetting waveform is maintained, and an applicable portion of thereof is converted sequentially, as required, to an ON and OFF pattern of rectangular pulse signals, instead of maintaining the ON and OFF pattern of the rectangular pulse signals itself as a drive controlling pattern. In this manner, as shown in FIG. 36, by simply correcting the amplification ratio in an amplifying circuit 102*h* that amplifying the length of the offsetting waveform output from the ANC filter circuit 102*f* along the time axis, correspondingly to the correction scale factor, the frequency of each of the rectangular pulse signals included in the original drive controlling pattern as described above can be readily multiplied by the correction scale factor. The amplifying circuit 102*h*, shown in FIG. 36, amplifies the length of the offsetting waveform in the time axis direction, not the amplitude thereof.

Third Embodiment

According to a third embodiment of the present invention, the drive controlling pattern is corrected by a method in which the correction method according to the first embodiment is combined with that according to the second embodiment.

Each variation of the printer according to the embodiment will now be explained. Unless otherwise specified, the structure of the printer according to each of the variations is the same as one according to the embodiment.

First Variation

Figure 37:
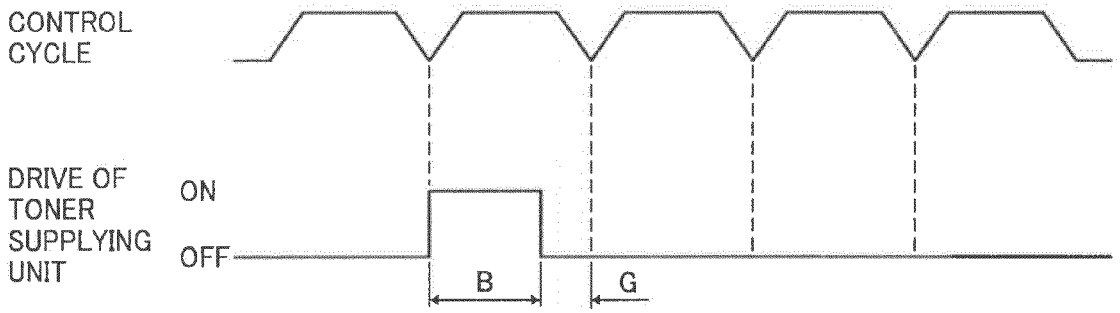
FIG. 37 is a graph for explaining a drive control unit performed in a printer according to a first variation.

A printer according to a first variation of the present invention is the same as one according to the embodiment excluding a point described below. As show in FIG. 37, the lower limit B in the time the toner supplying unit is driven is combined with a subsequent stop time G, and this combination is considered as a drive controlling unit, and the driving of the toner supplying unit is turned ON and OFF following such a drive controlling unit. An experiment demonstrated that the toner avalanche would not occur regardless how long this drive controlling unit is repeated, as long as the stop time G is placed after the lower limit B. In this manner, a toner avalanche can be avoided.

Second Variation

A printer according to a second variation of the present invention develops a color image using a revolver developing apparatus. More specifically, the printer includes a drum-shaped revolver developing apparatus with its axial direction arranged horizontally. The revolver developing apparatus holds the C, M, and Y developing units with a rotating supporting body. Every time the rotating supporting body is rotated for 90 degrees, a developing unit of a different color is moved to a position facing a photoconductor. In this manner, the developing units are switched according to the rotation angle of the rotating supporting body in the revolver developing apparatus, to sequentially develop the K, C, M, and Y latent images, sequentially formed on the photoconductor, into the K, C, M, and Y toner images. These K, C, M, and Y toner images are overlapped one another, and transferred onto the intermediate transfer body.

The revolver developing unit holds the K, C, M, and Y toner cartridges in removable and attachable manner. These toner cartridges are rotated around the rotation of the rotating supporting body, rotating around a rotation axis thereof. Taking advantage of the rotation, the toner is ejected from each of the toner cartridges, temporarily stored in a temporary toner storage. By way of the driving rotation of the rotating member, the toner is supplied from the temporary toner storage into the developing unit. In such a structure, if the development of a predetermined color is continued for a long time, with the revolver developing unit kept stopped at a predetermined rotation angle, the amount of toner stored in the temporary toner storage of the color will gradually decrease. If a monochromatic image having a high image-area ratio is continuously printed under this condition, the larger amount of toner will become supplied from the developing unit from the temporary toner storage, in comparison to the amount supplied from the toner cartridge to the temporary toner storage, supplied by the rotation of the revolver developing apparatus. In this manner, a space is created in the temporary toner storage. If the toner density in the temporary toner storage decreases in this manner, the less amount of toner is supplied in a time unit. In other words, the higher the average image-area ratio is, the lower the toner supply capability of the toner supplying unit becomes.

Table 4 indicates an example of a data table used for determining the correction coefficient in the printer.

TABLE 4

| Cumulative Average of Image-Area Ratio [% or below] | Correction Coefficient α |
|---|---|
| 5 | 0.80 |
| 10 | 0.85 |
| 15 | 0.90 |
| 20 | 1.00 |
| 30 | 1.05 |
| 40 | 1.10 |
| 50 | 1.12 |
| 60 | 1.15 |
| 70 | 1.18 |
| 80 | 1.20 |
| 90 | 1.20 |
| 100 | 1.20 |

The higher the moving average is, the higher correction coefficient α is selected, considering the fact that the higher the average image-area ratio is, the lower the toner supply capability of the toner supplying unit becomes. Data tables shown in Tables 5 and 6 may also be used, as long as a higher correction coefficient α is selected correspondingly to the increase in the moving average.

TABLE 5

| Cumulative Average of Image-Area Ratio [% or below] | Correction Coefficient α |
|---|---|
| 5 | 1.00 |
| 10 | 1.00 |
| 15 | 1.00 |
| 20 | 1.00 |
| 30 | 1.00 |
| 40 | 1.00 |
| 50 | 1.00 |
| 60 | 1.00 |
| 70 | 1.00 |
| 80 | 1.00 |
| 90 | 1.10 |
| 100 | 1.20 |

TABLE 6

| Cumulative Average of Image-Area Ratio [% or below] | Correction Coefficient α |
|---|---|
| 5 | 0.80 |
| 10 | 0.90 |
| 15 | 1.00 |
| 20 | 1.00 |
| 30 | 1.00 |
| 40 | 1.00 |
| 50 | 1.00 |
| 60 | 1.00 |
| 70 | 1.00 |
| 80 | 1.00 |
| 90 | 1.00 |
| 100 | 1.00 |

Third Variation

A controlling unit 100 in a printer according to a third variation of the present invention performs an imaging performance adjusting process immediately after turning on the printer, upon starting a print job after waiting for a long time for a print command from a user, and every time a predetermined number of paper sheets are printed.

Figure 38:
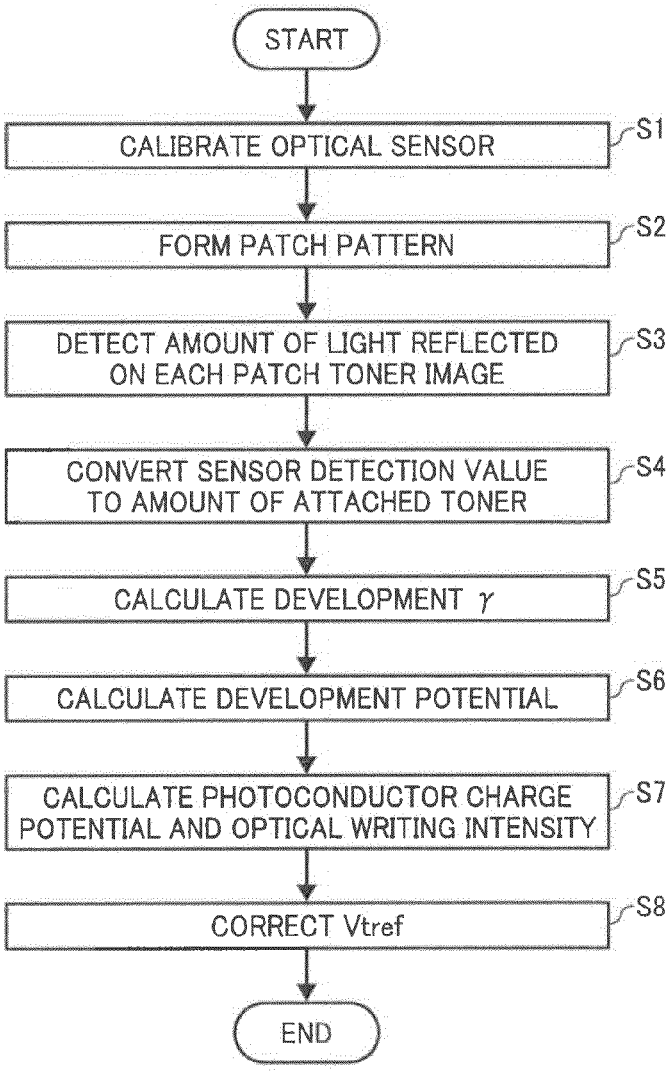
FIG. 38 is a flowchart of an imaging performance adjusting process performed by a controlling unit according to a third variation.
Figure 39:
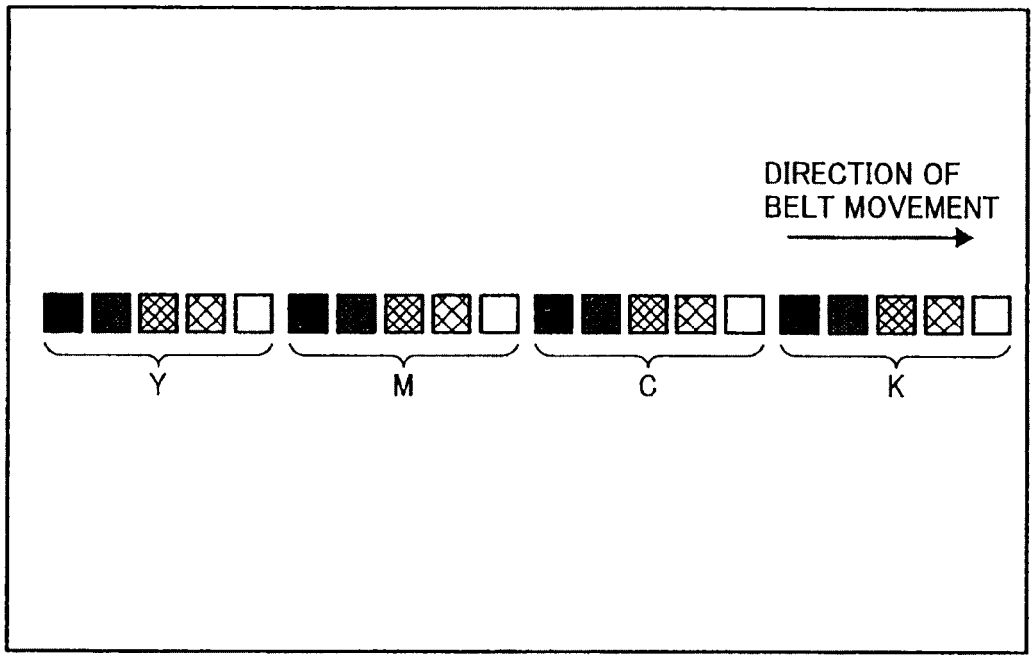
FIG. 39 is a schematic diagram of a patch pattern formed on an intermediate transfer belt.

FIG. 38 is a flowchart of the imaging performance adjusting process performed by the controlling unit according to the third variation. As a prerequisite for the imaging performance adjusting process to be performed, the printer must include an optical sensor that is a reflective-type photosensor for detecting the amount of attached toner based on a reflection in an area unit of a toner image formed on the photoconductor of each color, or that is formed on the intermediate transfer belt. In the imaging performance adjusting process, the optical sensor is calibrated to begin with (S1). More specifically, light emitted from a light emitting element of the optical sensor is reflected on a pure member surface having no toner image, and the amount of light emitted from the light emitting element (LED current) is adjusted so that the voltage output from a light receiving element in the optical sensor, receiving the reflected light, is adjusted to a predetermined voltage. The pure member surface herein is a surface of a photoconductor, if the optical sensor is configured to detect the amount of toner attached to a toner image on the surface of the photoconductor. The pure member surface can also be a surface of an intermediate transfer belt, if the optical sensor is configured to detect the amount of toner attached to a toner image on the surface of the intermediate transfer belt. According to the third variation, patch toner images are formed on the intermediate transfer belt as shown in FIG. 39. Five patch toner images are formed in each of the colors, with different amounts of toner attached thereto, resulting in twenty patch toner images. The optical sensor, arranged facing the belt, detects the amount of toner attached on each of the twenty patch toner images included in a patch pattern.

After calibrating the optical sensor, a predetermined patch pattern is formed (S2). More specifically, a plurality of patch-like latent images, each having a predetermined shape, is formed on the photoconductor, each with a different writing light intensity, and the electric potentials of these patch-like latent images are detected by an electric potential sensor. These patch-like latent images are developed with different developing biases (voltages applied to the developing roller) to form a patch pattern including a plurality of predetermined patch toner images.

When such a patch pattern is formed, the amount of light reflected on the surface of each of the patch toner images, included in the patch pattern, is detected by the optical sensor (S3). The detection results are sequentially converted into data of the amount of attached toner per an area unit (S4). Out of the patch toner images of K, C, M, and Y, for K, only an intensity of a specular reflection is detected. For C, M, and Y, both intensities of a specular reflection and of a diffuse reflection are detected.

After obtaining the amount of toner attached to each of the patch toner images, a development γ (development performance) is obtained based on the results (S5). More specifically, a development potential that is the difference between the electric potential of the latent image and the developing bias is calculated for each of the patch toner images. Then, a linear approximation of the relationship between the development potential and the amount of toner attached to the corresponding patch toner image is obtained by least squares (the inclination is called to be the development γ, and a segment x is called to be a development initiating voltage). Instead of the linear approximation, a secondary approximate curve may also be obtained. If the secondary approximate curve is to be obtained, the development γ will be a differential at the point where a target amount of attached toner is obtained.

Then, a potential required to obtain a target amount of attached toner is determined in the linear approximation, and a developing bias for realizing the development potential is calculated (S6). More specifically, the developing bias is calculated based on a formula "Developing Bias [−V]=Development Potential-Latent Image Potential [V]". Because the latent image potential is approximately −50[V], the developing bias will be a value of the latent image potential subtracted from the development potential with the plus or the minus sign reversed.

Once the developing bias is calculated, the uniformly-charged potential of the photoconductor and the optical writing intensity of the optical writing unit are calculated (S7). For the calculation of the uniformly-charged potential, a formula "Uniformly-Charged Potential [V]=Developing Bias [−V]−200 [V]" is used. The value −200 [V] is a background potential for preventing the background from becoming smeared. The background potential is offset from the developing bias toward the polarity of the charged toner by a predetermined degree. The optical writing intensity is obtained in the range from 80 to 120(%) based on a predetermined conversion formula that executes a conversion according to the uniformly-charged potential of the photoconductor. For a print job thereafter, a combination of the calculated developing bias, the uniformly-charged potential, and the optical writing intensity is used.

Then, the target voltage Vtref that is a control target for the toner concentration is corrected (S8). More specifically, the development γ calculated based on the amount of attached toner (hereinafter, referred to as "imaging development γ") is compared with a target development γ. If the imaging development γ is higher than the target development γ, the target voltage Vtref is corrected to a greater value (to lower the toner concentration target). If the imaging development γ is higher than the target development γ, it means that the imaging has been performed with the development γ that is higher than the target development γ. In such a situation, the development γ will be lowered, in comparison to the one used up to that point in time, for the next print job and thereafter, and the target value of the toner concentration must be also lowered. On the contrary, if the imaging development γ is lower than the target development γ, the target voltage Vtref is corrected to a smaller value (to raise the toner concentration target).

Figure 40:
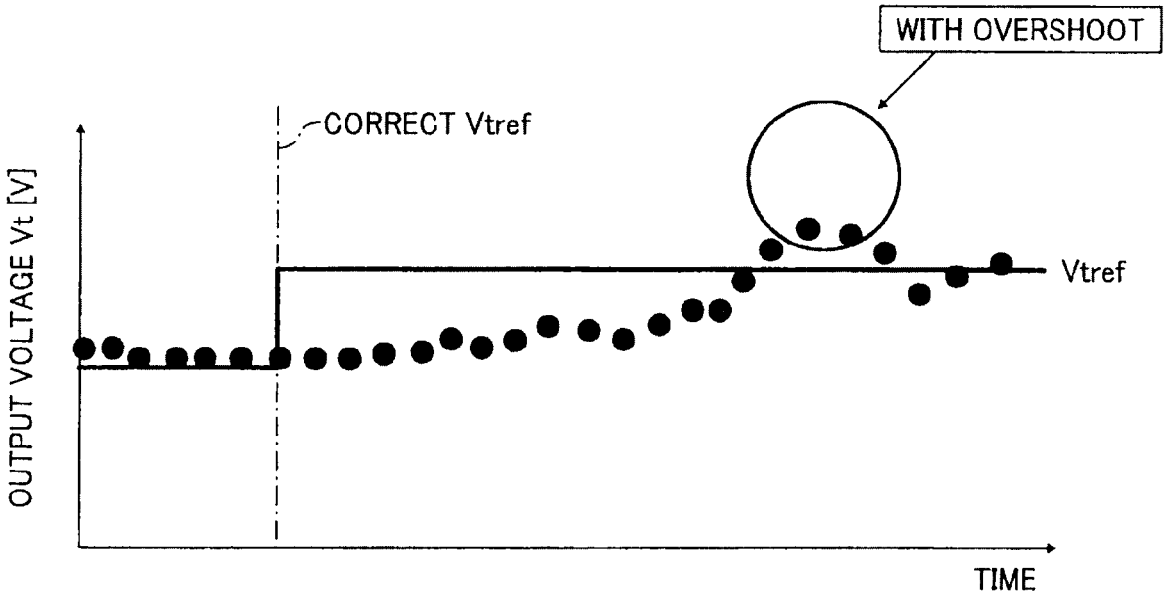
FIG. 40 Related Art
FIG. 40 is a graph representing the behavior of an output voltage Vt immediately after a target voltage Vtref is corrected (conventional example)

If the target voltage Vtref is corrected according to the imaging performance adjusting process described above, the difference between the output voltage Vt and the target voltage Vtref will be relatively great immediately after the correction. Such a difference will gradually become smaller, and become almost none as the drive controlling pattern is corrected based on the difference between the Vt average and the target voltage Vtref, while several tens of paper sheets are being printed thereafter. However, during the period, the images will be temporarily output in a lighter or darker density than the target. Therefore, it is preferable to raise or lower the output voltage Vt to the target voltage Vtref as quickly as possible, immediately after correcting the target voltage Vtref. If the amplitude of the simulated impulse signal is corrected based on the difference between the Vt average and the target voltage Vtref, in the manner described in the second embodiment, the output voltage Vt might be caused to overshoot temporarily after gradually bringing the output voltage Vt closer to the target voltage Vtref, after performing the correction of the target voltage Vtref, as shown in FIG. 40.

Therefore, the supply controlling unit 102 is structured to temporarily change the amount of toner supplied per image-area ratio unit after correcting the target voltage Vtref, until the output voltage Vt rises or drops to the corrected target voltage Vtref or its approximation. The supply controlling unit 102 temporarily changes the amount of toner supplied per image-area ratio in a manner described below. In other words, the amplitude of the simulated impulse signal is changed temporarily. Table 7 indicates the relationship between the imaging development γ, the correction of the Vtref, and the correction scale factor for the simulated impulse signal, used for temporarily changing the amount of supplied toner (hereinafter, referred to as "supply correction scale factor").

TABLE 7

| | Imaging Development γ | | | | |
|---|---|---|---|---|---|
| | Very High | High | Near Target | Low | Very Low |
| Correction of Vtref | Made Much Higher Vtref = Vt + 0.2 | Made Higher Vtref = Vt + 0.1 | Not Changed Vt = Vtref | Made Lower Vtref = Vt − 0.1 | Made Much Lower Vtref = Vt − 0.2 |
| Temporary Supply Correction Scale Factor | ×0.5 | ×0.8 | ×1 | ×1.2 | ×1.5 |

As shown in Table 7, if the imaging development γ is higher than the target, the target voltage Vtref is corrected to a higher value (the target toner concentration is lowered), and the amplitude of the simulated impulse signal is temporarily made less than one time thereof, so that the toner is temporarily supplied in an amount less than one time thereof per image-area ratio unit (supply correction scale factor). In this manner, the amount of toner supply is temporarily reduced, so that the output voltage Vt that is lower than the target voltage Vtref is immediately raised to the target voltage Vtref. On the contrary, if the imaging development γ is lower than the target, the target voltage Vtref is corrected to a smaller value (the target toner concentration is brought up). At the same time, the amplitude of the simulated impulse signal is temporarily made higher than one time thereof, so that the toner is supplied in an amount greater than one time thereof per image-area ratio unit. In this manner, the amount of supplied toner is temporarily increased, so that the output voltage Vt that is higher than the target voltage Vtref is immediately brought down to the target voltage Vtref.

Figure 41:
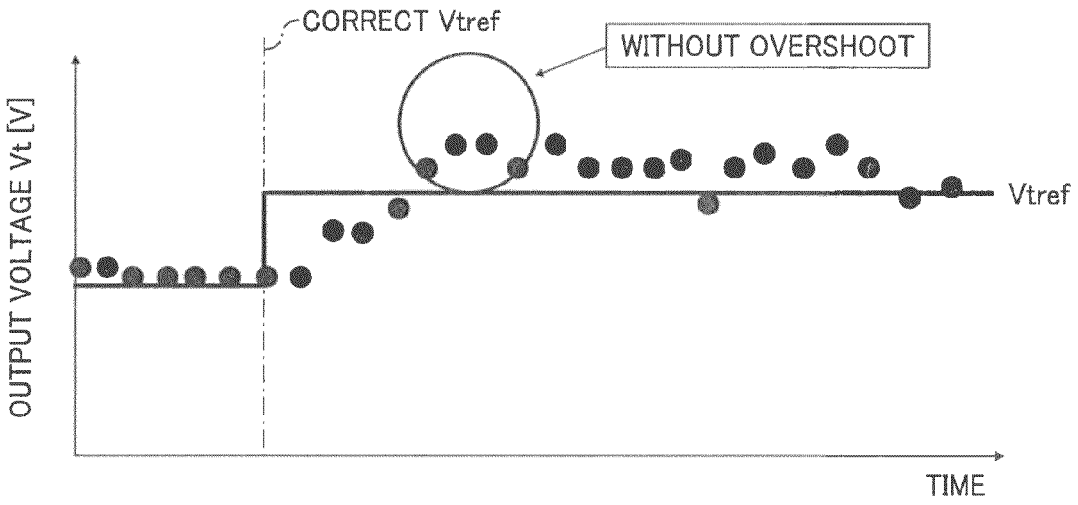
FIG. 41 is a graph representing the behavior of an output voltage Vt immediately after a target voltage Vtref is corrected (the third variation)

By temporarily changing the amount of toner supplied per image-area ratio after correcting the target voltage Vtref in the manner described above, the output voltage Vt, after correcting the target voltage Vtref, is immediately caused to reach the target voltage Vt as shown in FIG. 41. In this manner, the image density can immediately reach a target, while preventing the output voltage Vt from overshooting. In this printer, the supply controlling unit 102 is structured to recover the amount of toner supply when the difference between the target voltage Vtref and the output voltage Vt becomes less than 0.02; however, the amount of toner supply may also be recovered after outputting a certain number of paper sheets, e.g., twenty.

Fourth Variation

A printer according to a fourth variation of the present invention is the same as that according to the third variation, excluding the method of correcting the target voltage Vtref.

Figure 42:
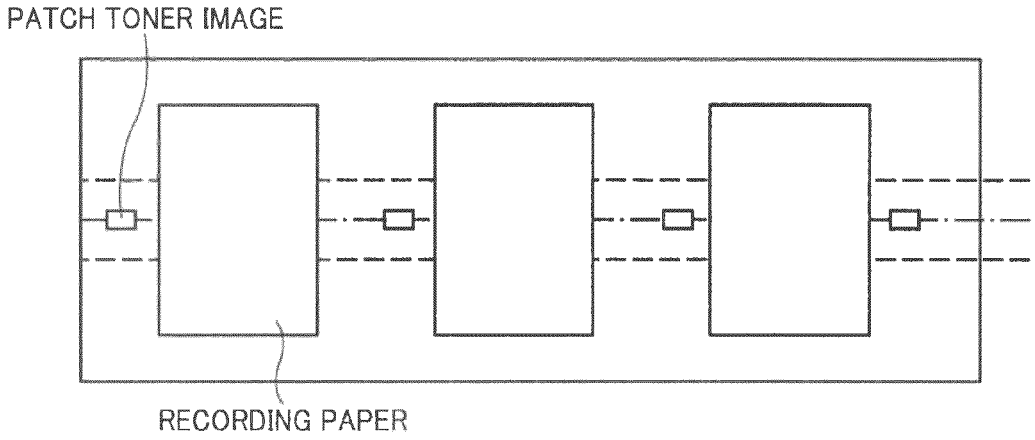
FIG. 42 is a schematic diagram for explaining a corresponding inter-paper space on the intermediate transfer belt, and a patch toner image formed in the corresponding inter-paper space.

The printer according to the fourth variation forms a toner patch image in a corresponding inter-paper space on the intermediate transfer belt when image forming operations are continuously executed. A corresponding inter-paper space on the intermediate transfer belt means an area of the surface of the intermediate transfer belt, located between the area brought in contact with the current recording paper sheet by way of the secondary transferring nip, and the area brought in contact with the next recording paper sheet, as shown in FIG. 42. Only one of the K, C, M, and Y patch toner images is formed on a corresponding inter-paper space. The reason why the only one patch toner image is formed is as follows. In other words, the printer according to the fourth variation includes only a single optical sensor, and this optical sensor can only detect a toner image formed at the center of the intermediate transfer belt in the width direction. Therefore, to enable the optical sensor to detect the four patch toner images of the colors K, C, M, and Y, these patch toner images must be arranged along the movement of the intermediate transfer belt. However, because the corresponding inter-paper space is relatively small, there is no sufficient space to arrange the four patch toner images along the movement of the intermediate transfer belt. Therefore, a single toner image is formed in each of the corresponding inter-paper spaces. In addition, the patch toner image is not formed in every corresponding inter-paper space; a patch toner image of each color is formed every time ten pages of printed paper sheets are output. Naturally, only one corresponding inter-paper space is available in the first ten-page worth of output; therefore, a K patch toner image is formed therein. Only for the first time, the C, M, and Y patch toner images are formed in the corresponding inter-paper space following the eleventh, the twelfth, and the thirteenth output page. For the second time and thereafter, these patch toner images are formed in every ten pages.

In the third embodiment, the development γ is measured as an index indicating the development capability. On the contrary, in the printer according to the second embodiment, the amount of toner attached on the patch toner image, formed on the corresponding inter-paper space, (hereinafter, referred to as the "amount of toner attached on the inter-paper patch") is measured as the index of the development capability. As shown in the graph in FIG. 43, when the amount of toner attached on the inter-paper patch exceeds a predetermined upper limit, or comes short with respect to a predetermined lower limit, the target voltage Vtref is corrected. Subsequently, until the output voltage Vt rises or drops to the corrected target voltage Vtref or an approximation thereof, the amount of toner supplied per image-area ratio unit is temporarily changed. As a method of temporarily changing the amount of toner supplied per image-area ratio unit, the amplitude of the simulated impulse signal is temporarily changed, in the same manner as in the third embodiment.

Table 8 indicates the relationship between the amount of attached toner on the inter-paper patch, a correction of Vtref, and the supply correction scale factor.

TABLE 8

| | Amount of Attached Toner | | | | |
|---|---|---|---|---|---|
| | Very High | High | Near Target | Low | Very Low |
| Correction of Vtref | Made Much Higher Vtref = Previous Vtref + 0.1 | Made Higher Vtref = Previous Vtref + 0.05 | Not Changed Vt = Previous Vtref | Made Lower Vtref = Previous Vtref − 0.05 | Made Much Lower Vtref = Previous Vtref − 0.1 |

TABLE 8-continued

| | Amount of Attached Toner | | | | |
|---|---|---|---|---|---|
| | Very High | High | Near Target | Low | Very Low |
| Temporary Supply Correction Scale Factor | ×0.5 | ×0.8 | ×1 | ×1.2 | ×1.5 |

As shown in Table 8, if the amount of toner attached on the inter-paper patch is higher than the target, the target voltage Vtref is corrected to a greater value (the target toner concentration is lowered). At the same time, the amplitude of the simulated impulse signal is temporarily made less than one time thereof, so that the toner is temporarily supplied in an amount less than one time thereof per image-area ratio unit (the supply correction scale factor). In this manner, the amount of supplied toner is temporarily reduced, so that the output voltage Vt that is lower than the target voltage Vtref is immediately raised to the target voltage Vtref. On the contrary, if the amount of toner attached on the inter-paper patch is less than the target, the target voltage Vtref is corrected to a smaller value (the target toner concentration is raised). At the same time, the amplitude of the simulated impulse signal is temporarily made higher than one time thereof, so that the toner is temporarily supplied in an amount greater than one time thereof per image-area ratio unit. In this manner, the amount of toner supply is temporarily increased, so that the output voltage Vt that is higher than the target voltage Vtref is immediately dropped to the target voltage Vtref.

Figure 43:
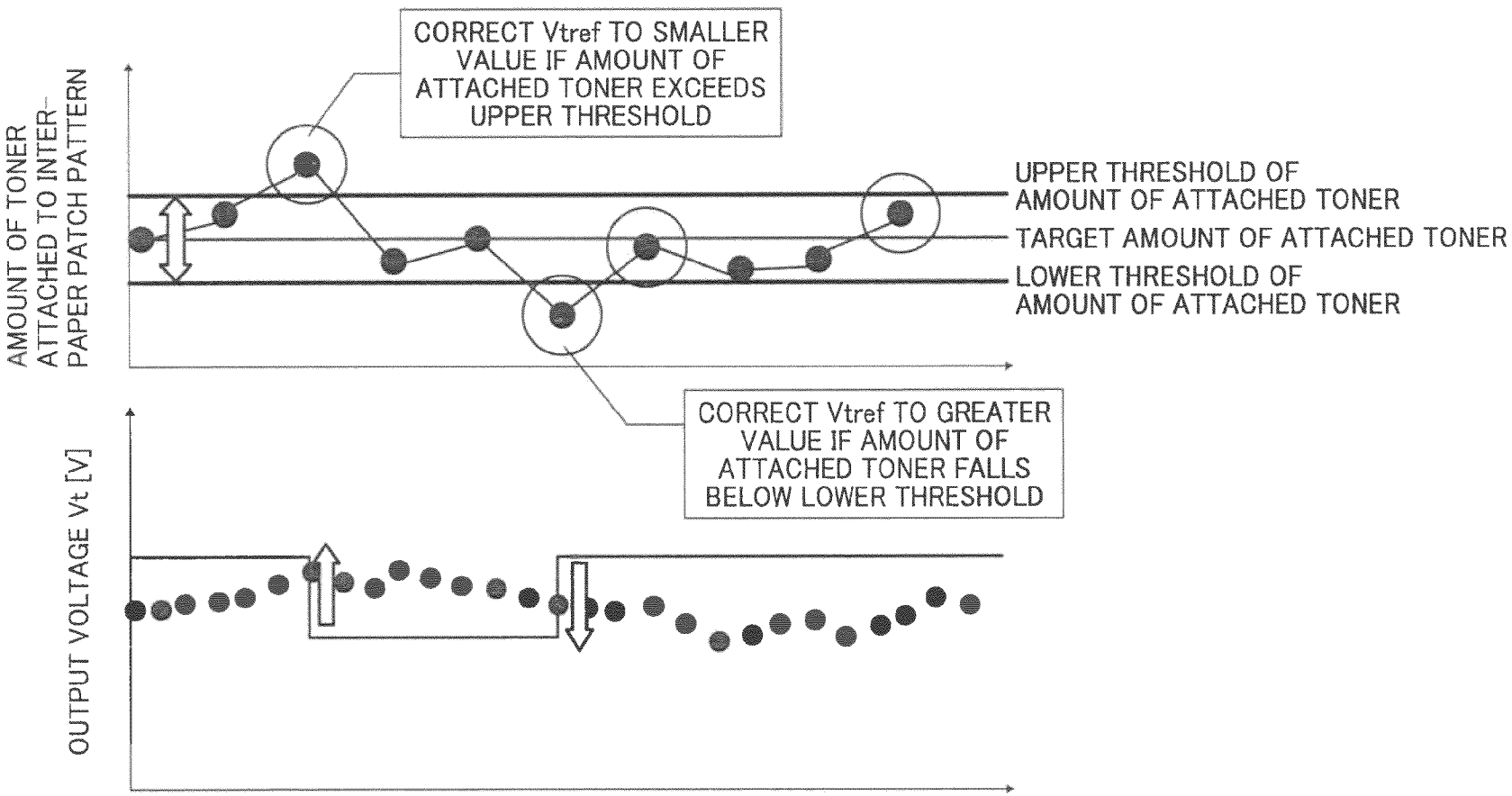
FIG. 43 is a graph of a variation in the amount of toner attached to the patch toner image and a variation in the output voltage Vt over time, observed in a printer according to a fourth variation.

By temporarily changing the amount of toner supplied per image-area ratio in the manner described above after correcting the target voltage Vtref, the output voltage Vt, after correcting the target voltage Vtref, is immediately caused to reach the target voltage Vt as shown in the lower graph of FIG. 43. In this manner, the image density will immediately reach a target, while preventing the output voltage Vt from overshooting. In addition, unlike the third embodiment, a patch pattern, including a plurality of patch toner images, is formed, and a dedicated process is performed for measuring the amount of toner attached to each of the patch toner images, independently from the printing operation. Thus, a downtime can be avoided.

According to the present invention, a toner concentration detecting unit is arranged downstream of a toner supplying opening in the direction in which developer is conveyed. The toner concentration detecting unit detects toner concentration of the developer after toner is added thereto through the toner supplying opening in a non-supply area of a circulation channel. If the toner concentration of the developer is lower than a target value, it is considered that the amount of supplied toner is less than the actual toner consumption (a shortage in the supply). If the toner concentration of the developer is higher than the target value, it is considered that the amount of supplied toner is greater than the actual toner consumption (an excess in the supply). In this manner, the controlling unit recognizes an excess or a shortage in the amount of supplied toner based on the detection result of the toner concentration, and corrects a determined value in the length of time the toner supplying unit is driven, determined based on the image information, based on the excess or the shortage. By way of this correction, the amount of supplied toner is adjusted to an amount appropriate for the actual toner consumption. Therefore, it is possible to avoid a development performance deterioration that might have occurred if the toner is kept supplied in an erroneous amount with respect to the actual toner consumption.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a latent image carrier that holds a latent image;

an image information obtaining unit that obtains image information;

a latent image forming unit that forms a latent image on the latent image carrier based on the image information;

a developing unit that conveys developer-containing toner and carrier along a predetermined circulation channel to a developing area that is an area where a developer holding body faces the latent image carrier by holding the developer on a moving surface of the developer holding body in a supply area that is an area of the circulation channel facing the developer holding body, that develops a latent image on the latent image carrier by attaching the toner in the developer thereto in the developing area, and returns the developer contributed to the development in the developing area to the supply area of the circulation channel along with the movement of the surface of the developer holding body;

a toner supplying unit that supplies toner to a non-supply area that is not the supply area in the circulation channel through a toner supplying opening arranged at a predetermined position in the non-supply area; and a controlling unit that determines a driving amount of the toner supplying unit based on the image information, wherein a toner concentration detecting unit is provided at a position downstream of the toner supplying opening in the non-supply area and upstream of the supply area to detect toner concentration in the developer, and the controlling unit is structured to recognize an excess or a shortage in an amount of supplied toner correspondingly to a detection result of the toner concentration detecting unit, and to correct a determined value of the driving amount determined based on the image information correspondingly to the excess or the shortage that has been recognized.

2. The image forming apparatus according to claim 1, wherein the controlling unit is structured to correct the determined value based on a result obtained by correcting the detection result of the toner concentration detecting unit correspondingly to the driving amount of the toner supplying unit based on Smith compensation.

3. The image forming apparatus according to claim 1, wherein the controlling unit is structured to create a drive controlling pattern, based on the image information, of the toner supplying unit, the drive controlling pattern being a toner supply variation pattern for cancelling out a toner concentration variation pattern that is expected to occur in the developer passing through the supply area, while correcting the drive controlling pattern as the determined value based on a detection result of the toner concentration detecting unit or to create the toner supply variation pattern as the determined value based on the image information, while correcting the toner supply variation pattern based on a detection result of the toner concentration detecting unit so as to create a drive controlling pattern that is to be used as a corrected toner supply variation pattern for the toner supplying unit.

4. The image forming apparatus according to claim 3, wherein the controlling unit is structured to obtain, for the toner supplying unit, an additional drive controlling pattern that is required to bring toner concentration in the developer to a target value, based on a detection result of the toner concentration detecting unit, and to correct the drive controlling pattern, created based on the image information, by synthesizing the additional drive controlling pattern thereto or to obtain a virtual toner concentration variation pattern of the developer until the current toner concentration of the developer reaches a predetermined target value based on the detection result, and to correct the toner supply variation pattern, created based on the image information, by synthesizing the virtual toner concentration variation pattern thereto.

5. The image forming apparatus according to claim 3, wherein the controlling unit is structured to obtain a correction scale factor for an amount of toner supplied per unit of image-area ratio to supplement a shortage in toner concentration in the developer after the toner is supplied based on the detection result of the toner concentration detecting unit, and to correct the drive controlling pattern or the toner supply variation pattern based on the correction scale factor.

6. The image forming apparatus according to claim 3, wherein the controlling unit is structured to obtain, for the toner supplying unit, an additional drive controlling pattern that is required to bring toner concentration in the developer to a target value based on a detection result of the toner concentration detecting unit, to obtain a correction scale factor for the amount of toner supplied per unit of image-area ratio to supplement a shortage in toner concentration in the developer after the toner is supplied based on the detection result, and to correct the drive controlling pattern, created based on the image information, based on the additional drive controlling pattern and the correction scale factor or to obtain a virtual toner concentration variation pattern of the developer until the current toner concentration of the developer reaches a predetermined target value, to obtain a correction scale factor for the amount of toner supplied per unit of image-area ratio to supplement a shortage in toner concentration in the developer after the toner is supplied based on the detection result, and to correct the toner supply variation pattern, created based on the image information, based on the virtual toner concentration variation pattern and the correction scale factor.

7. The image forming apparatus according to claim 3, wherein the controlling unit is structured to temporarily stop driving the toner supplying unit when a time period during which the toner supplying unit has been continuously driven reaches a predetermined value, and, upon restarting driving the toner supplying unit, to control the driving of the toner supplying unit in a pattern obtained by synthesizing a portion of the drive controlling pattern corresponding to a time period during which the driving is temporarily stopped to a portion of the drive controlling pattern corresponding to a time subsequent to the time period during which the drive is temporarily stopped.

8. The image forming apparatus according to claim 1, wherein the controlling unit is structured to set a lower limit to a time period from start to end of driving of the toner supplying unit, and to set the driving of the toner supplying unit ON and OFF according to a condition to ensure a driving time equal to or longer than the lower limit.

9. The image forming apparatus according to claim 1, wherein the controlling unit is structured to establish a pattern, as a unit of drive control, in which the toner supplying unit is stopped for a predetermined length of time before or after the toner supplying unit is driven for a predetermined length of time, and to set the driving of the toner supplying unit ON and OFF based on the unit of drive control.

10. The image forming apparatus according to claim 1, wherein the controlling unit is structured to obtain a moving average of an area ratio of an output image based on the image information, and to correct the amount of toner supplied per unit image-area ratio based on the moving average.

11. The image forming apparatus according to claim 10, wherein the controlling unit is structured to perform a correction to reduce the amount of toner supplied per unit image-area ratio when the moving average is equal to or higher than a predetermined value, and to increase the amount of toner supplied per unit image-area ratio when the moving average is lower than the predetermined value.

12. The image forming apparatus according to claim 10, wherein the controlling unit is structured to perform a correction to increase the amount of toner supplied per unit image-area ratio when the moving average is equal to or higher than a predetermined value, and to reduce the amount of toner supplied per unit image-area ratio when the moving average is lower than the predetermined value.

13. The image forming apparatus according to claim 1, further comprising an attached toner detecting unit that detects an amount of toner attached per unit area of a toner image developed by the developing unit, wherein the controlling unit is structured to correct a target value of toner concentration based on a result of detection performed on a predetermined toner image, developed at a predetermined timing, by the attached toner detecting unit, and subsequently to temporarily change the amount of toner supplied per unit image-area ratio for a predetermined length of time.

14. The image forming apparatus according to claim 13, wherein the controlling unit is structured to temporarily increase the amount of toner supplied per unit image-area ratio when the target value is corrected to a higher value, and to temporarily reduce the amount of toner supplied when the target value is corrected to a lower value.

15. The image forming apparatus according to claim 13, wherein the controlling unit is structured to obtain development $\gamma$ that is an index of development performance, based on a detection result of the attached toner detecting unit, and subsequently to correct the target value based on the development $\gamma$.

16. The image forming apparatus according to claim 13, wherein the controlling unit is structured to form the predetermined toner image on a surface of the latent image carrier in an area between a recording member conveyed previously and a recording member conveyed subsequently in the image forming apparatus during a continuous image forming operation in which images are successively formed on a plurality of recording members.

* * * * *